US009905410B2

(12) United States Patent
Ristroph et al.

(10) Patent No.: US 9,905,410 B2
(45) Date of Patent: Feb. 27, 2018

(54) TIME-OF-FLIGHT MASS SPECTROMETRY USING MULTI-CHANNEL DETECTORS

(71) Applicant: Agilent Technologies, Inc., Santa Clara, CA (US)

(72) Inventors: Trygve Ristroph, Santa Clara, CA (US); Julia Zaks, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 14/959,795

(22) Filed: Dec. 4, 2015

(65) Prior Publication Data

US 2016/0225602 A1 Aug. 4, 2016

Related U.S. Application Data

(60) Provisional application No. 62/110,508, filed on Jan. 31, 2015.

(51) Int. Cl.
*H01J 49/40* (2006.01)
*H01J 49/00* (2006.01)

(52) U.S. Cl.
CPC ..... *H01J 49/40* (2013.01); *H01J 49/009* (2013.01)

(58) Field of Classification Search
CPC ..... H01J 49/009; H01J 49/446; H01J 49/40; H01J 49/408
See application file for complete search history.

(56) References Cited

U.S. PATENT DOCUMENTS

| | | | | |
|---|---|---|---|---|
| 4,472,631 | A * | 9/1984 | Enke | B01D 59/44 250/281 |
| 5,376,788 | A * | 12/1994 | Standing | H01J 49/0045 250/282 |
| 7,126,114 | B2 * | 10/2006 | Chernushevich | H01J 49/0031 250/281 |
| 7,772,547 | B2 | 8/2010 | Verentchikov | |
| 8,193,489 | B2 | 6/2012 | Bertsch et al. | |
| 2008/0087814 | A1 | 4/2008 | Loucks | |
| 2013/0175440 | A1 | 7/2013 | Perelman et al. | |

* cited by examiner

*Primary Examiner* — Wyatt Stoffa
*Assistant Examiner* — Eliza Osenbaugh-Stewart

(57) ABSTRACT

A time-of-flight mass spectrometer (TOF-MS) utilizes a multi-channel ion detector to detect ions traveling in separate flight paths, spatially dispersed along a drift axis and/or a transverse axis, in a flight tube of a TOF analyzer. The ion beams may be dispersed by drift energy, deflection along the drift and/or transverse axis, ion mass, or a combination of two or more of the foregoing. The dispersion may be carried out before, at, or after an ion accelerator of the TOF analyzer. Ion packets may be accelerated into the flight tube at a multi-pulse firing rate. Tandem MS may be implemented on parallel ion beams simultaneously.

20 Claims, 13 Drawing Sheets

TIME-OF-FLIGHT MASS SPECTROMETRY USING MULTI-CHANNEL DETECTORS

RELATED APPLICATIONS

This application claims the benefit of U.S. Provisional Patent Application Ser. No. 62/110,508, filed Jan. 31, 2015, titled "TIME-OF-FLIGHT MASS SPECTROMETRY USING MULTI-CHANNEL DETECTORS," the content of which is incorporated by reference herein in its entirety.

TECHNICAL FIELD

The present invention relates generally to time-of-flight mass spectrometry (TOF-MS), and particularly to processing multiple ion beams in TOF-MS instruments.

BACKGROUND

A mass spectrometry (MS) system in general includes an ion source for ionizing molecules of a sample of interest, followed by one or more ion processing devices providing various functions, followed by a mass analyzer for separating ions based on their differing mass-to-charge ratios (or m/z ratios, or more simply "masses"), followed by an ion detector at which the mass-sorted ions arrive. An MS analysis produces a mass spectrum, which is a series of peaks indicative of the relative abundances of detected ions as a function of their m/z ratios. Mass spectrometers are commonly used to determine the chemical composition of mixtures by precise measurement of the mass-to-charge ratio of the constituent molecular ions.

One particular type of mass spectrometer is a time-of-flight mass spectrometer (TOF-MS), which is utilized for molecular and elemental identification within a variety of disciplines ranging from medicine, biological research, environmental monitoring, chemical manufacturing, energy, and forensics. Time-of-flight mass spectrometry (TOF-MS) offers a powerful combination of mass resolution, accuracy, speed, and mass range which together make the technique well-suited for the analytical challenges presented by these fields. TOF-MS utilizes a high-resolution mass analyzer (TOF analyzer) in the form of a flight tube, which encloses a space that is electric field-free except for localized fields imparted by devices in the flight tube such as an ion mirror. An ion accelerator (or pulser) injects ions in pulses (or packets) into the flight tube. Ions of differing masses travel at different velocities through the flight tube and thus separate (spread out) according to their differing masses before arriving at the ion detector, enabling mass resolution based on time-of-flight. In a typical TOF-MS, ions travel along a drift direction through one or more gas-filled ion guides, and one or more beam-limiting apertures operating in a collision-free environment, and into the pulsed ion accelerator. In an orthogonal acceleration TOF-MS (oaTOF-MS), the ion accelerator receives the ions along the drift direction and injects the ions along an acceleration direction orthogonal to the drift direction. The flight tube may include one or more ion mirrors (or "reflectrons") that increase the length of the ion flight path and provide certain advantages.

In TOF-MS, chemical composition is determined by accurately measuring the masses of individual ions drawn from the sample. The critical mass measurement stage is realized by measuring the time elapsed as ions travel from an ion accelerator through a known path length. Ions end their flight on a fast ion detector at which a single ion is transformed into a nanosecond-scale electronic signal, which is digitized with a high speed data acquisition system. The inherent simplicity and speed of this process translates into multiple analytical advantages for the end user. Because TOF-MS is able to gather a complete mass spectrum for each firing of the ion accelerator, it is particularly well-suited for tandem mass spectrometry (MS/MS) in which the fragmentation spectrum associated with a particular parent ion mass is measured.

Orthogonal-acceleration TOF-MS instruments have a primary ion beam that travels at low energy (10-50 eV) in a direction known as the drift direction, and an ion accelerator that accelerates the ions in an acceleration direction orthogonal to the drift direction. A well-known problem attending a TOF-MS instrument is that its duty cycle is inherently inefficient. The origin of the duty-cycle inefficiency lies in the fact that the ion accelerator is inherently pulsed while most mass spectrometer ion sources are continuous. The mass analysis time, and hence the firing period of the ion accelerator, is equal to the time-of-flight for the largest mass measured (i.e., the longest flight time associated with any ion packet injected into the flight tube) and is generally much longer than the time it takes to fill the ion accelerator. Consequently, ions that enter the ion accelerator more than one fill-time before the next firing of the ion accelerator are lost. The duty cycle is the portion of ions of the primary ion beam that is accelerated and transmitted through the ion accelerator into the TOF mass analyzer. Duty cycle is equal to the ratio of the ion accelerator fill-time to the firing period and depends on ion mass.

Known methods for improving duty cycle loss can be divided into two classes. The first class of methods involves trapping the ions before the ion accelerator to create a pulsed beam from the original continuous beam. The trapping methods suffer from difficulties associated with ejecting the ions from the trap with appropriate timing, particularly when ion-ion repulsion is considered, as well as the ion loss associated with the mass separation between the ion trap and the ion accelerator. The second class of methods employ what is known as "multi-pulsing" or "multiplexing" wherein the ion accelerator is fired to inject a new ion packet before the previous ion packet has completed its flight path in the mass analyzer. Multi-pulsing results in more than one ion packet being present in the flight tube at the same time, which can lead to overlapping between successive ion packets, with the slower ions of one ion packet being overtaken by the faster ions of a subsequently fired ion packet. Multi-pulsing thus often necessitates reconstruction of a meaningful mass spectrum from the convoluted raw detector data, which requires some means of determining from which accelerator firing each detected ion originates. Known multi-pulsing methods use slight variations in pulse firing time (dithering) to encode the firing number. Signal processing algorithms are then used to reconstruct the actual mass spectrum based on the knowledge of the encoding scheme. The algorithms rely on statistical inference and are subject to error due to imperfect reconstruction, and often require a large amount of computer processing.

Therefore, there is a need for improving the duty cycle in TOF-MS while avoiding the problems associated with the known, conventional approaches.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a time-of-flight mass spectrometry (TOF-MS) system includes: an ion source; a TOF analyzer comprising an ion accelerator, a flight tube, and an ion detector comprising a plurality of channels; and an ion dispersion device configured for dispersing ions from the ion source into a plurality of spatially separated flight paths in the flight tube, wherein respective channels are aligned with the flight paths.

According to another embodiment, a method for performing time-of-flight mass spectrometry (TOF-MS) includes: transmitting ions along a drift axis into an ion accelerator; injecting the ions as a plurality of sequential ion packets from the ion accelerator into a flight tube; modulating a drift energy of the ions according to a repeating modulation sequence comprising a plurality of iterations, wherein the drift energy at each iteration is different from the drift energies of the other iterations, and wherein the ions travel in the flight tube in a plurality of flight paths spatially separated along the drift axis; and detecting arrival times of the ions at a plurality of channels of an ion detector aligned with the respective flight paths.

According to another embodiment, a method for performing time-of-flight mass spectrometry (TOF-MS) includes: transmitting ions along a drift axis into an ion accelerator; injecting the ions as a plurality of sequential ion packets from the ion accelerator into a flight tube; modulating a transverse position the ions such that the ions travel in the flight tube in a plurality of flight paths spatially separated along a transverse axis orthogonal to the drift axis; and detecting arrival times of the ions at a plurality of channels of an ion detector aligned with the respective flight paths.

According to another embodiment, a method for performing time-of-flight mass spectrometry (TOF-MS) includes: transmitting ions along a drift axis into an ion accelerator; injecting the ions into a flight tube in a plurality of sequential accelerator firing events; detecting arrival times of the ions at a multi-channel ion detector; measuring masses of the ions of each of the ion packets; and based on the detected arrival times and measured masses, determining from which accelerator firing event each ion was injected.

According to another embodiment, a method for performing time-of-flight mass spectrometry (TOF-MS) includes: transmitting ions into a sector instrument, and outputting the ions from the sector instrument in a plurality of mass-discriminated ion beams that are spatially separated along a transverse axis; transmitting the ion beams simultaneously into an ion accelerator along a drift axis orthogonal to the transverse axis; injecting ion packets from each of the ion beams into a flight tube, wherein the ion packets travel through the flight tube simultaneously in a plurality of flight paths spatially separated along the transverse axis, the flight paths corresponding to the respective ion beams; and detecting arrival times of the ions at a plurality of channels of an ion detector aligned with the respective flight paths.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
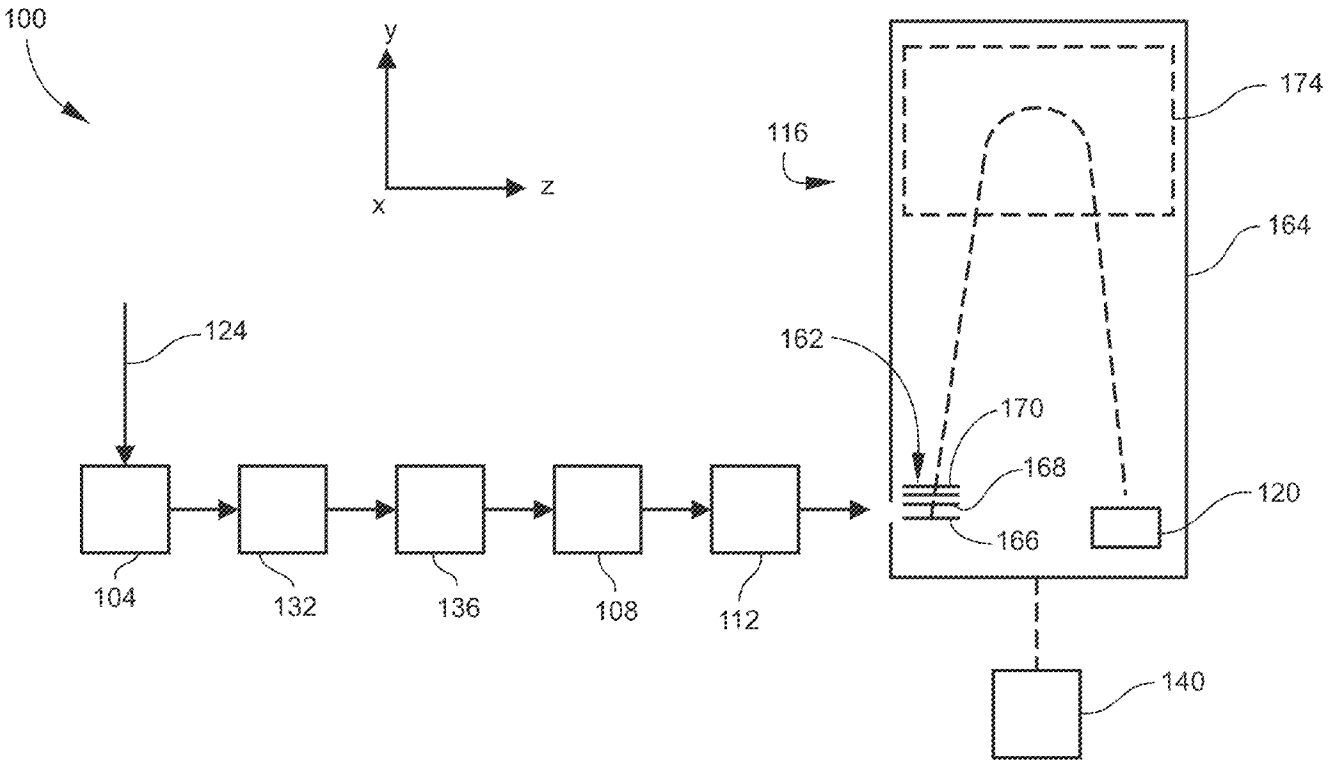
FIG. 1 is a schematic view of an example of a time-of-flight mass spectrometer (TOF-MS) or time-of-flight mass spectrometry (TOF-MS) system according to some embodiments, which may be utilized in the implementation of the subject matter described herein.

FIG. 1 is a schematic view of an example of a time-of-flight mass spectrometer (TOF-MS) or time-of-flight mass spectrometry (TOF-MS) system 100 according to some embodiments, which may be utilized in the implementation of the subject matter disclosed herein. The operation and design of various components of TOF-MS systems are generally known to persons skilled in the art and thus need not be described in detail herein. Instead, certain components are briefly described to facilitate an understanding of the subject matter presently disclosed.

For illustrative purposes, FIG. 1 (and other figures) includes a Cartesian coordinate frame of reference comprising a drift axis (z-axis), an acceleration axis (y-axis) orthogonal to the drift axis, and a transverse axis (x-axis) (into and out of the drawing sheet, in FIG. 1) orthogonal to the acceleration axis and to the drift axis. The acceleration axis and the transverse axis, which may both be referred to herein as "transverse" axes, lie in a transverse (x-y) plane orthogonal to the drift (z) axis. The coordinate frame is primarily intended to show the relative orientations of the three axes; the origin (0,0,0) of the coordinate frame relative to the TOF-MS system 100 has been arbitrarily located. In the present disclosure, the term "direction" may be used interchangeably with the term "axis." The primary direction of ion travel through the TOF-MS system 100 is along the drift axis, left to right from the perspective of FIG. 1.

The TOF-MS system 100 may generally include, in series of ion process flow along the drift axis, an ion source 104, one or more ion guides 108, ion optics 112, a time-of-flight (TOF) mass analyzer (TOF analyzer) 116, an ion detector 120, and a computing device 140. In general operation, sample molecules are introduced into the ion source 104, and the ion source 104 produces ions from sample molecules and transmits the ions to the ion guide(s) 108. The ion guide(s) 108 focus the ions as an ion beam and transmit the ions to the ion optics 112. The ion guide(s) 108 may perform additional ion processing functions such as compressing the ion beam, thermalizing (cooling) the ions, and other functions described below. The ion optics 112 transmit the ions to the TOF analyzer 116. The ion optics 112 may provide a collision-free environment and include beam-limiting apertures that shape the ion beam. The TOF analyzer 116 allows the ions to disperse based on differing flight times (due to their differing mass-to-charge (m/z) ratios) and travel to the ion detector 120. The ion detector 120 produces an ion signal that is then utilized to calculate actual times-of-flight from which m/z ratios are correlated, and construct a mass spectrum descriptive of the sample molecules as appreciated by persons skilled in the art.

The ion source 104 may be any type of continuous-beam or pulsed ion source suitable for producing analyte ions for spectrometry. Examples of ion sources 104 include, but are not limited to, electron ionization (EI) sources, chemical ionization (CI) sources, photo-ionization (PI) sources, electrospray ionization (ESI) sources, atmospheric pressure chemical ionization (APCI) sources, atmospheric pressure photo-ionization (APPI) sources, field ionization (FI) sources, plasma or corona discharge sources, laser desorption ionization (LDI) sources, and matrix-assisted laser desorption ionization (MALDI) sources. In some embodiments, the ion source 104 may include two or more ionization devices, which may be of the same type or different type. Depending on the type of ionization implemented, the ion source 104 may reside in a vacuum chamber or may operate at or near atmospheric pressure. Sample material to be analyzed may be introduced to the ion source 104 by any suitable means, including hyphenated techniques in which the sample material is an output 124 of an analytical separation instrument such as, for example, a gas chromatography (GC) or liquid chromatography (LC) instrument (not shown).

One or more ion guides 108 may include an arrangement of electrodes configured for confining ions along an axis while enabling the ions to be transmitted along the axis. For this purpose, depending on the type of ion guide radio frequency (RF) and/or direct current (DC) voltages may be applied to the ion guide electrodes. One or more of the ion guides 108 may have a converging geometry that compresses the ion beam so as to improve transmission into the next device. One or more of the ion guides 108 may be configured as a multipole structure with electrodes elongated generally along the direction of ion travel. One or more of the ion guides 108 may alternatively be configured as a straight cylindrical stacked-ring structure or an ion funnel, with ring-shaped electrodes or aperture-containing plate electrodes oriented orthogonal to the direction of ion travel. As a further alternative, one or more of the ion guides 108 may have a planar geometry as described below.

The ion optics 112 may occupy an evacuated volume of a desired axial length between the ion guide(s) 108 and the entrance to the TOF analyzer 116. The evacuated volume may be essentially collision-free, i.e., substantially devoid of neutral gas-phase molecules. The ion optics 112 may include one or more ion lenses arranged about an axis. An ion lens may be, as examples, a cylindrical electrode coaxial with the axis, a plate with an aperture on-axis, or pair of plates or half-cylinders separated by a gap on-axis. DC potentials may be applied to one or more of the ion lenses. One or more of the ion lenses may be configured as an ion slicer that ensures that the geometry of the ion beam matches the acceptance area of the entrance to the TOF analyzer 116, and that the ion energy distribution in at least one direction transverse to the direction of ion travel is a desired low value.

The TOF analyzer 116 includes an ion accelerator 162 leading into an evacuated TOF flight tube 164 that defines an electric field-free flight region. In the illustrated embodiment, the ion accelerator 162 is an orthogonal ion accelerator that receives ions along the drift (z) axis and accelerates ion packets into the flight tube 164 along the acceleration (y) axis. For this purpose the electrodes of the ion accelerator 162 may include a repeller plate 166 (bottom electrode), acceleration grids 168 above the repeller plate 166, and a top grid or exit grid 170 above the acceleration grids 168. Ions enter the ion accelerator 162 in a loading region between the repeller plate 166 and the acceleration grids 168, and are accelerated into the flight tube 164 through application of appropriate potentials to the repeller plate 166 and acceleration grids 168. In the orthogonal configuration, the flight tube 164 is elongated along the acceleration (y) axis.

The illustrated embodiment further has a reflectron configuration in which the ion detector 120 is positioned generally at the same axial end (relative to the acceleration axis) of the flight tube 164 as the ion accelerator 162, and spaced at a distance along the drift axis from the ion accelerator 162. An ion mirror (or reflector) 174 is positioned at the opposite axial end (relative to the acceleration axis) of the flight tube 164, whereby the ion mirror 174 is spaced from both the ion accelerator 162 and the ion detector 120 along the acceleration (y) axis.

The ion mirror 174 may be a single-stage, dual-stage, or gridless reflectron. The ion mirror 174 generates a potential gradient that decelerates ions down to zero velocity along the y direction and then accelerates the ions in the opposite direction, whereby ions exit the ion mirror 174 at the same kinetic energy they had when they entered the ion mirror 174. However, for ions of the same mass (m/z ratio), faster ions entering the ion mirror 174 sooner at higher kinetic energies penetrate deeper into the ion mirror 174 before stopping and turning around to exit, in comparison to slower ions of the same mass as the faster ions. These slower ions enter the ion mirror 174 later at lower kinetic energies and do not penetrate as far into the ion mirror 174 as the faster ions before stopping and turning around to exit. Hence, the slower ions do not spend as much time in the ion mirror 174 as the faster ions of the same mass, and thus are able to catch up with the faster ions such that all slower ions and faster ions of the same mass arrive at the ion detector 120 ideally at the same time. The ion mirror 174 thus creates a reflected focal point at the location of the ion detector 120, and reduces the variation in flight time spread due to the kinetic energy spread of ions of the same mass. The ion mirror 174 also increases the focal length of the TOF analyzer 116 and thus the overall flight times of the ions, which improves peak separation. FIG. 1 schematically depicts a representative ion flight path 178 through the flight tube 164, including the turning point imposed by the ion mirror 174.

In operation, the ion accelerator 162 accelerates (injects) ions into the flight tube 164 at a predetermined pulsing rate (or firing rate). Hence, the ion accelerator 162 injects discrete ion packets (or ion pulses) into the flight tube 164. Each ion packet may include a range of ion masses. In each ion packet, ions of different masses travel through the flight tube 164 at different velocities and thus have different overall times-of-flight, i.e., ions of smaller masses travel faster than ions of larger masses. Each ion packet spreads out (is dispersed) in space in accordance with the time-of-flight distribution. The ion detector 120 detects and records the time that each ion arrives at (impacts) the ion detector 120. A data acquisition process implemented by the computing device 140 correlates the recorded times-of-flight with m/z ratios.

In some embodiments, the ion accelerator 162 is operated at a multi-pulsing (or multiplexing) rate. In the multi-pulsing or multiplexing mode, the ion accelerator 162 fires at a rate fast enough that more than one ion packet occupies the flight tube 164 at the same time. That is, before all ions of a previous ion packet have completed their flight paths in the flight tube 164 and reached the ion detector 120, the next ion packet is injected into the flight tube 164.

In typical embodiments of the present disclosure, the ion detector 120 is a multi-channel ion detector. As appreciated by persons skilled in the art, a multi-channel ion detector is configured for collecting and measuring the flux (or current) of mass-discriminated ions over a plurality of channels. Each channel, or pixel, corresponds to a discrete detection area or spot on the detector face, and is capable of detecting the impact of an ion at that detection spot and convert the detection event into an electrical signal independently from the other channels. Thus, a multi-channel ion detector is capable of making multiple measurements at multiple positions on the detector, and thereby generate multiple measurement signal outputs. Moreover, multiple channels can operate in this manner simultaneously provided they are spatially (optically) aligned with multiple ion flight paths. Each channel, for example, may be configured or operate as an individual electron multiplier, with each detection spot being a slot or tube. The size of the detection spots, and the spacing between adjacent detection spots, may be on the order of micrometers (e.g., less than 20 μm). The multiple channels may be arranged in a one-dimensional (linear) array along a desired direction (e.g., the drift axis or transverse axis), or in a two-dimensional (2D) array. One non-limiting example of a multi-channel detector is a micro-channel plate (MCP) detector.

In some embodiments, the TOF-MS system 100 may be configured for implementing tandem MS (MS/MS). For example, the TOF-MS system 100 may be configured as a qTOF, or QqTOF instrument. Thus, the TOF-MS system 100 may include a first mass analyzer 132 upstream of the other mass analyzer 116 (the second, or final mass analyzer, in such embodiments), and an ion fragmentation device 136 between the first mass analyzer 132 and the second mass analyzer 116. The first mass analyzer 132 is configured for selecting ions of a specific m/z ratio (mass) or m/z ratio range and is typically, but not necessarily, configured as a quadrupole mass filter. The ion fragmentation device 136 is often a collision cell, which typically includes a non-mass-resolving, RF-only ion guide enclosed in a cell. The collision cell is pressurized by an inert gas to a level sufficient for producing fragment ions by collision-induced dissociation (CID) as appreciated by persons skilled in the art. However, a fragmentation device other than a CID-based device may be utilized such as, for example, a device configured for implementing electron capture dissociation (ECD), electron transfer dissociation (ETD), or infrared multiphoton dissociation (IRMPD). The second mass analyzer 116 resolves the fragment ions outputted by the ion fragmentation device 136 on the basis of m/z ratio (mass,) and transmits the mass-resolved fragment ions to the ion detector 120, which outputs measurement signals from which fragment mass spectra are then produced.

The TOF-MS system 100 also includes a vacuum system for maintaining various interior regions of the TOF-MS system 100 at controlled, sub-atmospheric pressure levels. As appreciated by persons skilled in the art, the vacuum system may include vacuum lines communicating with the various interior regions via vacuum ports or exhaust ports, one or more vacuum-generating pumps, and associated components. The vacuum lines may also remove residual non-analytical neutral molecules from the ion path of the TOF-MS system 100.

The TOF-MS system 100 may also include a computing device (or system controller) 140. The computing device 140 is schematically depicted as representing one or more modules (or units, or components) configured for controlling, monitoring and/or timing various functional aspects of the TOF-MS system 100 described above. One or more modules of the computing device 140 may be, or be embodied in, for example, a desktop computer, laptop computer, portable computer, tablet computer, handheld computer, mobile computing device, personal digital assistant (PDA), smartphone, etc. The computing device 140 may also schematically represent all voltage sources not specifically shown, as well as timing controllers, clocks, frequency/waveform generators and the like as needed for applying voltages to various components of the TOF-MS system 100, including voltages applied to an ion dispersion device such as an ion deflector, sector instrument, or ion lenses as described below. The computing device 140 may also be configured for receiving the ion detection signals from the ion detector 120 and performing tasks relating to data acquisition and signal analysis as necessary to generate chromatograms, drift spectra, and mass (m/z ratio) spectra characterizing the sample under analysis. The computing device 140 may also be configured for providing and controlling a user interface that provides screen displays of spectrometric data and other data with which a user may interact. The computing device 140 may include one or more reading devices on or in which a tangible computer-readable (machine-readable) medium may be loaded that includes instructions for performing all or part of any of the methods disclosed herein. For all such purposes, the computing device 140 may be in signal communication with various components of the TOF-MS system 100 via wired or wireless communication links (as partially represented, for example, by a dashed line between the computing device 140 and the TOF analyzer 116). Also for these purposes, the computing device 140 may include one or more types of hardware, firmware and/or software, as well as one or more memories and databases.

In the conventional operation of a TOF-MS system, the average drift-energy of the primary ion beam transmitted into the ion accelerator 162 is typically 10-50 eV and fixed to ensure the ions hit a single-channel detector. The drift energy, together with the flight path length and energy, determine where the ion detector 120 should optimally be located to capture the ions. In the conventional TOF-MS system, the drift energy is fixed for optimum detection efficiency. In such a system, the duty cycle is inherently low as described above. The duty cycle can be improved by operating in a multi-pulsing mode, but conventionally this has required demultiplexing algorithms that are problematic, as also described above.

Figure 2:
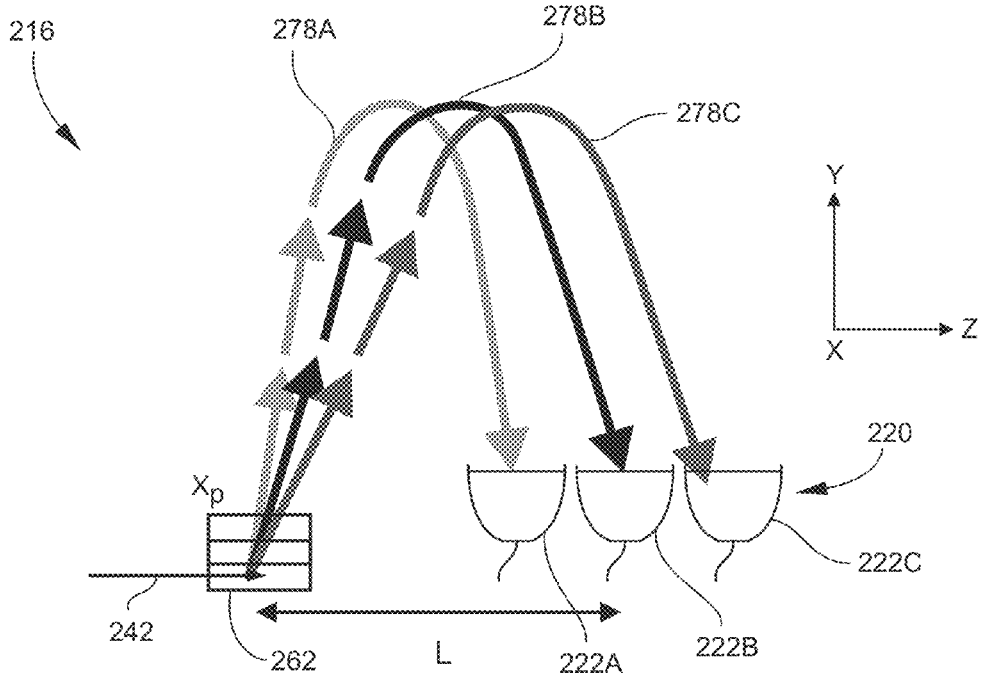
FIG. 2 is a schematic view in the y-z plane of an example of a TOF analyzer according to some embodiments.

According to some embodiments of the present disclosure, a technique referred to herein as "drift energy labeling" or "drift energy modulation" is provided to improve the duty cycle of a TOF-MS system. In this technique, the drift energy of the ions is modulated between successive firings of the ion accelerator to send ion packets from successive acceleration pulses to different channels of the ion detector. One embodiment of the drift energy labeling technique is illustrated in FIG. 2. FIG. 2 is a schematic view in the y-z plane of an example of a TOF analyzer 216, showing an ion accelerator 262 and a multi-channel ion detector 220. A repeating pulse sequence of N ion pulses (N firing events of the ion accelerator 262) is defined. In the illustrated example N=3 but in other examples may be less than or more than 3. The drift energy of the ions in each iteration (firing of the ion accelerator 262) of the pulse sequence is set to a value different from the respective drift energies of the ions in the other iterations of the sequence. Thus in the illustrated example (N=3), the ions of a first ion packet injected during "firing number 1" of the ion accelerator 262 have a first drift energy, the ions of a second (next) ion packet injected during "firing number 2" have a second drift energy different from the first drift energy, and the ions of a third (next) ion packet injected during "firing number 3" have a third drift energy different from the first drift energy and from the second drift energy. This sequence may be repeated any number of times during the normal course of analyzing the sample under investigation by way of TOF-MS. Each different value of drift energy is uniquely associated with one of the iterations (firing numbers) of the sequence. Hence, the ion pulses of the sequence are encoded by the drift energy values respectively assigned to the ion pulses.

As illustrated in FIG. 2, the drift energy of a given ion determines the flight path that the ion ultimately takes to arrive at the ion detector 220. That is, ions having different drift energies will travel through the flight tube along different flight paths. Different channels of the ion detector 220 are aligned with the different flight paths. In the illustrated example, a primary ion beam 242 is transmitted into the ion accelerator 262 during a loading phase. The drift energy is modulated such that in the first pulse of the sequence the ion packet travels along a first flight path 278A, and in the second pulse of the sequence the ion packet travels along a second flight path 278B, and in the third pulse of the sequence the ion packet travels along a third flight path 278C. As schematically illustrated in FIG. 2, because the drift energy is different during each iteration of the pulsing sequence, the flight paths 278A, 278B, and 278C are spatially separated from each other along the drift axis. The ion detector 220 includes a plurality of different detector channels. In the present embodiment, the ion detector 220 at the least includes a plurality of different ion detector channels 222A, 222B, and 222C spaced along the drift axis. The ion detector channels 222A, 222B, and 222C are spatially (or optically) aligned with the respective flight paths 278A, 278B, and 278C. Thus, signals outputted by the ion detector channels 222A, 222B, and 222C can be correlated with the respective flight paths 278A, 278B, and 278C, and thus with the respective ion packets injected by the respective accelerator firing numbers of the repeating sequence.

A small range of drift energies may map onto each particular detector channel 222A, 222B, and 222C. If the drift energy spread is small enough, the drift energy of a particular accelerator pulse and its corresponding detector channel 222A, 222B, and 222C can encode the accelerator firing number (firing event). By cycling through a series of predetermined drift energies, the ion accelerator 262 can be fired faster than normal and hence duty cycle is improved. It can be seen that this drift energy modulation technique makes multi-pulsing feasible and desirable, as any deconvolution process needed to construct a single TOF mass spectrum from the raw spectral information obtained from the signals outputted from the ion detector channels 222A, 222B, and 222C may be quite simple and accurate.

Figure 3:
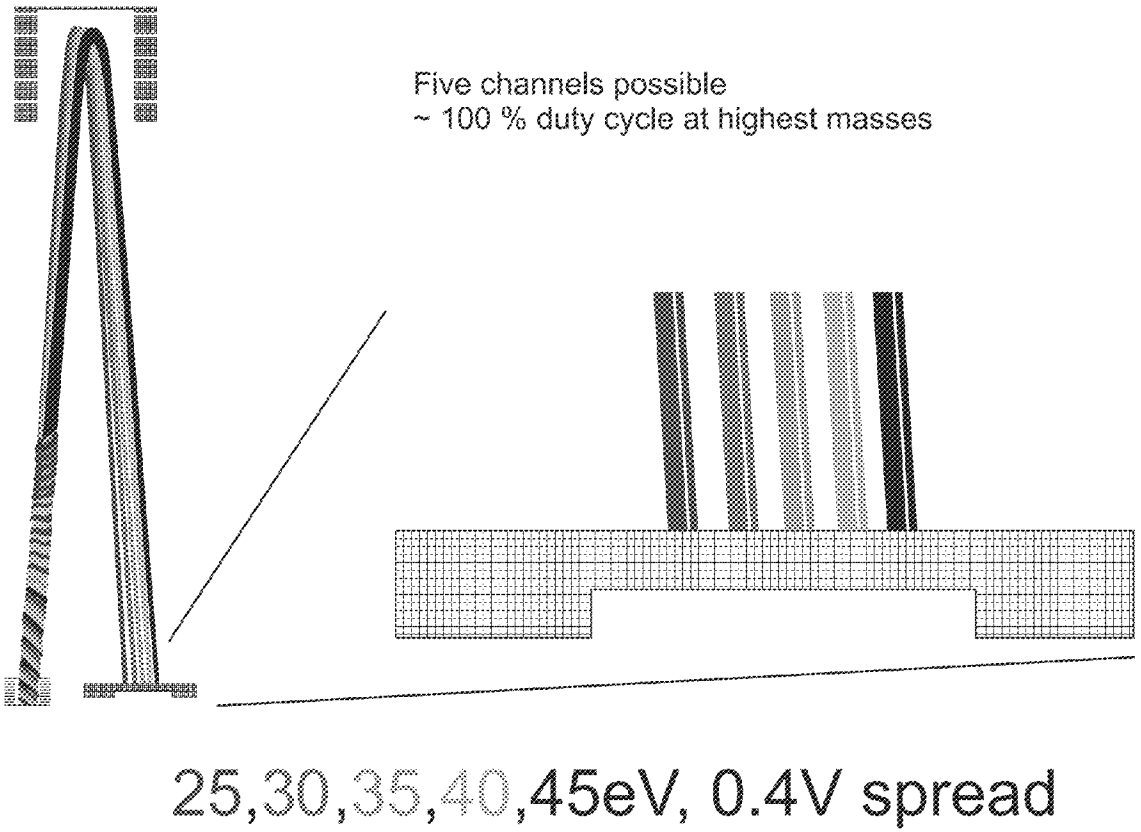
FIG. 3 illustrates an example of a simulation of a TOF analyzer operating with five ion channels in a 1-meter long TOF flight tube, according to some embodiments.

Denoting the number of detector channels as $N_{det}$, it is seen that the duty cycle is improved by a factor of $N_{det}$, up to the point at which it reaches 100%. The maximum number of detector channels may be determined by the available space and the ability of the ion optics to focus the primary beam into resolvable spots on the ion detector 220. The resolvable spot size, and hence $N_{det}$, may be determined by the drift energy spread and the tolerable resolution loss associated with the ion focusing. FIG. 3 illustrates an example of a simulation of a TOF analyzer operating with five ion channels in a 1-meter long TOF flight tube, where the duty cycle is improved by 5× when the drift energy spread is 0.4 eV.

Figure 4:
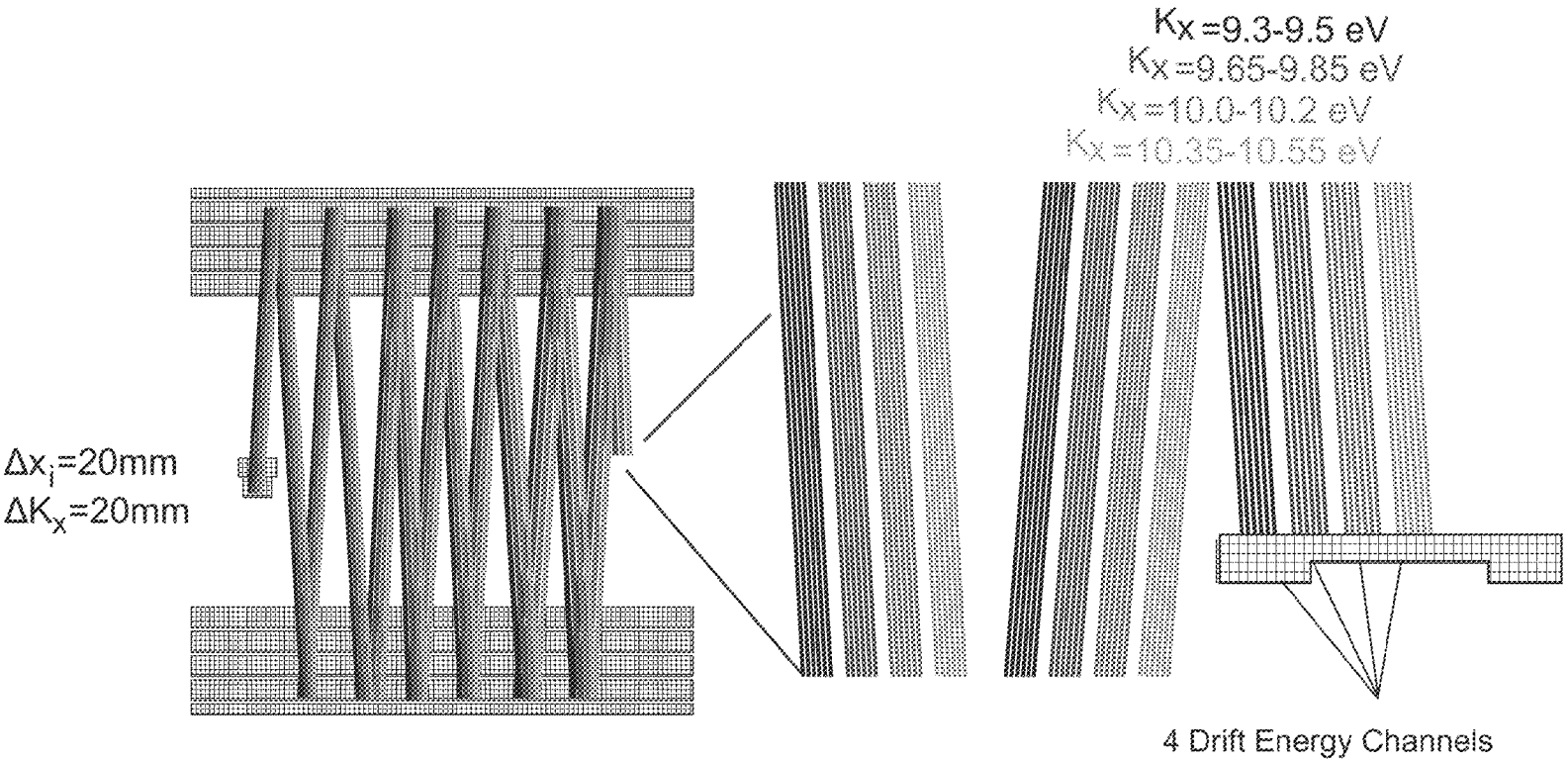
FIG. 4 illustrates an example of a simulation of a multi-reflecting TOF instrument with four ion channels in a 13-meter flight path, according to some embodiments.

For longer TOF instruments, including multi-reflecting TOF instruments, the relative energy modulation may be less than 0.4 eV. FIG. 4 illustrates an example of a simulation of a multi-reflecting TOF instrument with a 13-meter flight path and four resolvable channels for a 0.2 eV energy spread. The drift energy modulation technique disclosed herein may be particularly well-suited for multi-reflecting planar TOF systems with gridless mirrors, as the planar symmetry of these mirrors allows for large acceptance along the drift direction. To further increase the number of detector channels, it may be advantageous to reduce the drift energy spread with buffer gas cooling in the ion beam source (i.e., at a location upstream of the TOF analyzer) and to optimize the optics that focus the ions into spots dispersed along the drift direction.

If it is not possible to reduce the drift energy, it may be advantageous to filter the ions by drift energy before they enter the ion accelerator 262. This might also be necessary for situations in which it is not possible to reduce the drift energy spread to an acceptable level (e.g., <0.5 eV) with buffer gas cooling. Such a filter could be one or more electrostatic mirrors, sectors, or lenses that separate ions in space based on their drift energy, in conjunction with an aperture that selects for ions of the required drift energy.

In some embodiments, drift energy modulation is performed on the ions in the primary ion beam 242 transmitted into the ion accelerator 262. For example, the drift energy modulation may be realized by varying the voltages that accelerate the primary ion beam 242 into the ion accelerator 262. The primary beam energy is determined by the difference in DC voltages applied to the ion beam source (e.g., ion optics upstream of the ion accelerator 262, such as a buffer gas filled RF ion guide) and the ion accelerator 262 prior to the application of the high-voltage pulse that injects the ions into the flight tube, i.e., during the loading phase. The drift energy modulation may be realized by varying either the ion beam source DC voltage or the accelerator DC voltage, or both. It may be particularly advantageous to vary the ion accelerator voltage applied during loading, since this method avoids complications associated with the intermixing of ions of different masses and different energies in the region between the ion beam source and the ion accelerator 262.

Figure 5:
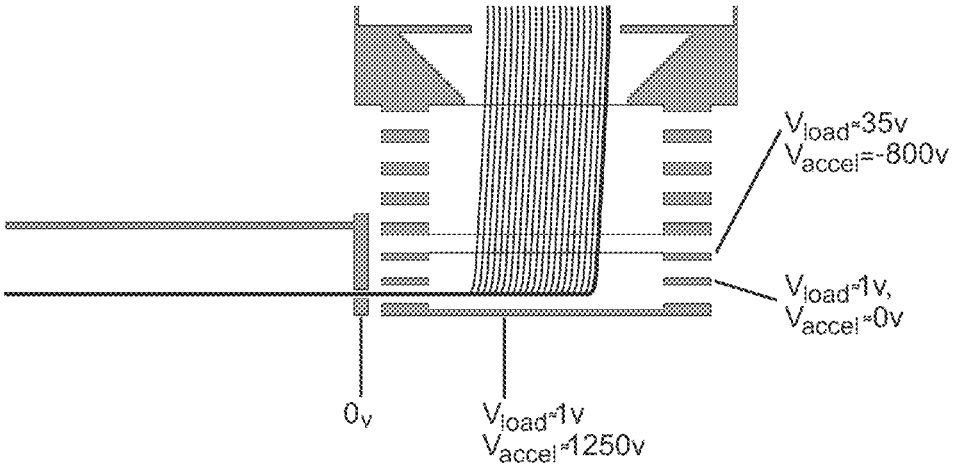
FIG. 5 is a schematic view of an example of an ion accelerator and upstream optics, illustrating examples of DC potentials that may be applied during the loading and acceleration phases.
Figure 6:
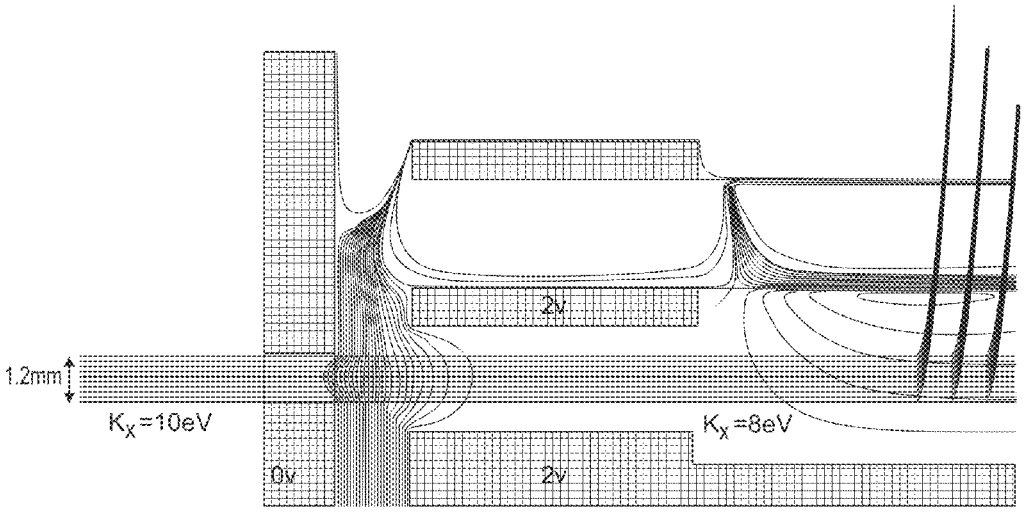
FIG. 6 is a zoomed-in view of the entrance region of the ion accelerator illustrated in FIG. 5.

FIG. 5 is a schematic view of an example of an ion accelerator and upstream optics, illustrating examples of DC potentials that may be applied during the loading and acceleration phases. In this example, the same loading voltage is applied to both the bottommost "pusher" electrode and the gridded electrode above it, so there is no deflecting electric field in the acceleration direction during the loading phase. The variation in the loading voltage magnitude between subsequent firings is typically 1 to 20 V depending on the flight path length. FIG. 6 is a zoomed-in view of the entrance region of the ion accelerator illustrated in FIG. 5. FIG. 6 shows that the expansion and focusing associated with a 2 V deceleration potential is minimal.

Figure 7:
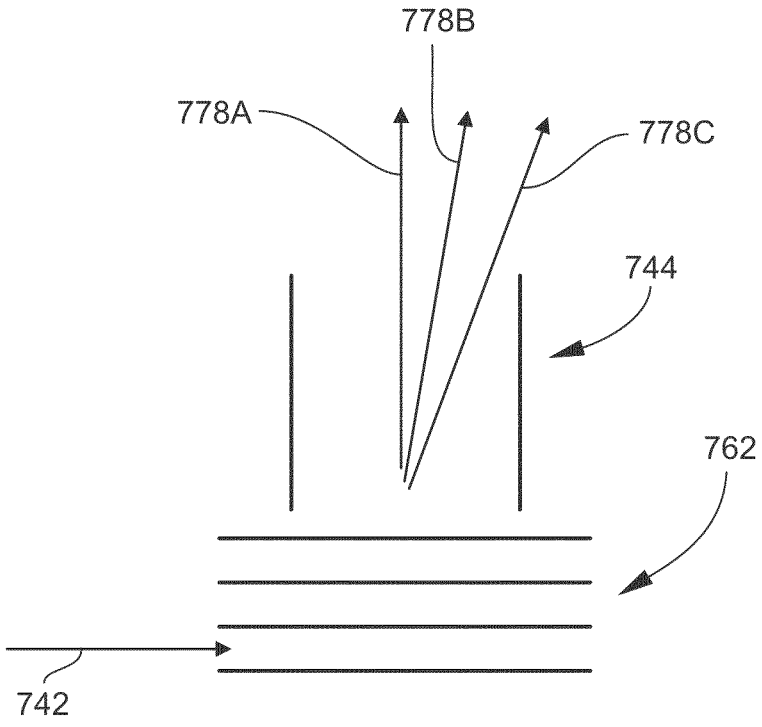
FIG. 7 is a schematic view of an example of an ion accelerator and an ion deflector according to some embodiments.

In other embodiments, drift energy modulation may be performed on the ions while they are in the accelerator or after they have been accelerated into the flight tube. For example, the effective drift energy may be modulated by operating an ion deflector that is integrated into the ion accelerator or positioned just after it in the flight tube. FIG. 7 is a schematic view of an example of an ion accelerator 762 and an ion deflector 744. In this example, the ion deflector 744 includes two parallel electrodes. However, the ion deflector 744 generally may be realized by various configurations entailing the use of various types of electrodes (e.g., plate electrodes, grid electrodes, etc.), as appreciated by persons skilled in the art. Generally, DC potentials are applied to the electrodes of the ion deflector 744 at magnitudes and polarities effective for producing N different flight paths (e.g., flight paths 778A, 778B, and 778C) spatially separated along the drift axis, containing ion packets extracted from a primary ion beam 742 transmitted into the ion accelerator 762, and associated with respective N firings of the ion accelerator 762 according to a predetermined repeatable sequence. It will be noted that the use of an ion deflector in the flight tube may cause TOF aberration, potentially degrading mass resolution, and thus may be less preferred than performing drift energy modulation on the ions prior to acceleration into the flight tube.

Figure 8:
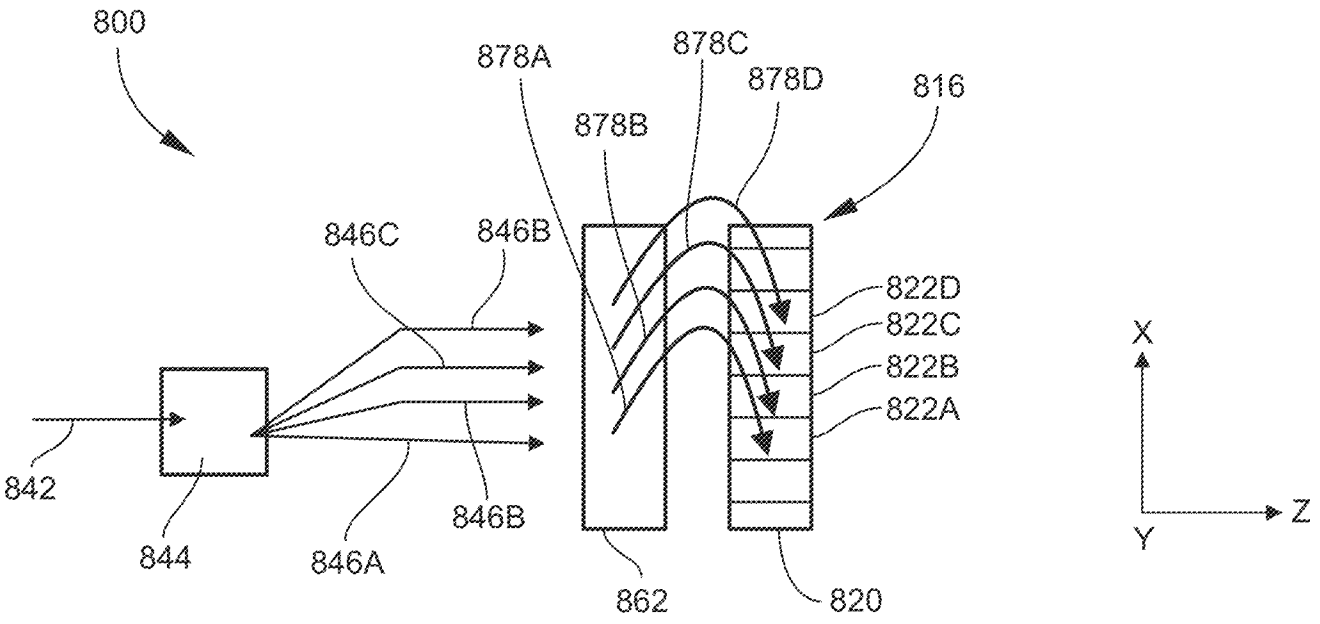
FIG. 8 is a schematic view in the x-z plane of an example of a TOF-MS system according to other embodiments.

According to other embodiments of the present disclosure, a technique referred to herein as "transverse position labeling" or "transverse position modulation" is provided to improve the duty cycle of a TOF-MS system. In this technique, the transverse position of the ions is modulated to send ion packets to different channels of the ion detector arranged along the transverse axis. One embodiment of the transverse position labeling technique is illustrated in FIG. 8. FIG. 8 is a schematic view in the x-z plane of an example of a TOF-MS system 800. The TOF-MS system 800 includes an ion dispersion device (or ion beam modulator) 844 followed by a TOF analyzer 816, which includes an ion accelerator 862 and a multi-channel ion detector 820. The ion detector 820 includes a plurality of detection channels, for example detection channels 822A, 822B, 822C, and 822D, spatially separated along the transverse axis. In the illustrated embodiment, the transverse position of the ions is modulated upstream of the ion accelerator 862. Accordingly, the ion dispersion device 844 is positioned upstream of the ion accelerator 862. The ion dispersion device 844 may be an ion deflector, such as described above. By varying DC potentials applied to appropriately positioned electrodes of the ion dispersion device 844, the ion dispersion device 844 converts a primary ion beam 842 into N different ion beams, for example ion beams 846A, 846B, 846C, and 846D. In the illustrated example N=4 but in other examples may be less than or more than 4.

The ion beams 846A, 846B, 846C, and 846D may then be transmitted into the ion accelerator 862, either simultaneously or at different firing rates. The ion accelerator 862 may then inject successive ion packets from each ion beam 846A, 846B, 846C, and 846D simultaneously. Consequently, the ion packets travel through the flight tube simultaneously (i.e., occupy the flight tube at the same time) in N different flight paths 878A, 878B, 878C, and 878D that are spatially separated along the transverse axis. The ions in the N different flight paths 878A, 878B, 878C, and 878D thus arrive at respective detection channels 822A, 822B, 822C, and 822D, which are spatially (or optically) aligned with the respective flight paths 878A, 878B, 878C, and 878D. The impact of an ion on a particular detection channel 822A, 822B, 822C, and 822D thus determines the ion packet (associated with one of the flight paths 878A, 878B, 878C, and 878D) and the ion beam 846A, 846B, 846C, and 846D from which that particular ion originated.

It will be noted that in FIG. 8, the bends in the flight paths 878A, 878B, 878C, and 878D are to be considered as being located at elevations on the acceleration axis. Thus, the flight paths 878A, 878B, 878C, and 878D are to be considered as projecting out of the drawing sheet.

Alternatively, the ion dispersion device 844 may be sector instrument. The sector instrument converts a primary ion beam 842 into N different ion beams, for example ion beams 846A, 846B, 846C, and 846D, by applying a static magnetic field and/or electrostatic field to the primary ion beam 842. In response to the magnetic field, ions of different masses will physically separate into the different ion beams 846A, 846B, 846C, and 846D. Use of a sector instrument in this case results in the ion beams 846A, 846B, 846C, and 846D, and thus the ion packets in the respective flight paths 878A, 878B, 878C, and 878D, spanning narrower mass ranges. The sector instrument may include one or more magnetic sectors, or one or more electric (electrostatic) sectors, or a combination of both, as appreciated by persons skilled in the art.

As schematically shown in FIG. 8, the ion accelerator 862 is configured so as to be wide enough along the transverse axis to simultaneously receive multiple, transversely spaced ion beams. The ion accelerator 862 thus may be considered as including multiple loading/injection sites. In some embodiments, the ion accelerator 862 may include a plurality of transversely spaced, individually controllable ion accelerators. The separate ion accelerators may be operated to accelerate ion packets from respective ion beams 846A, 846B, 846C, and 846D simultaneously and at the same firing rate, or at different rates. Similarly, the TOF analyzer 816 may include one wide ion mirror or multiple ion mirrors in the flight tube.

The transverse position labeling technique implements multi-pulsing at least by way of simultaneously transmitting respective ion packets in parallel flight paths in the flight tube, and simultaneously detecting ion arrival times at the same number of detector channels. In some embodiments, the ion packets are accelerated at a normal (non-multiplexed) firing rate. In this case, with $N_{det}$ detector channels, again it is seen that the duty cycle is improved by a factor of $N_{det}$, up to the point at which it reaches 100%. Moreover, the raw data produced by the $N_{det}$ detector channels are easily processed to construct a single mass spectrum. In other embodiments, the ion packets may be accelerated at a multiplexed firing rate, resulting in more than one ion packet traveling in each parallel flight path in the flight tube at the same time. In this case, some form of deconvolution/demodulation/decoding algorithm would likely be required to produce an easily interpretable mass spectrum.

In still other embodiments, a combination of the drift energy labeling technique described above and the transverse position labeling technique may be implemented. This combined technique enables ion packets to be accelerated at a multiplexed firing rate simultaneously into multiple parallel, transversely spaced flight paths. The combined technique, which may be characterized as entailing "two-dimensional" multi-pulsing or multiplexing, may result in a significantly improved duty cycle. The combined technique further enables a simplified demodulation algorithm to be implemented. The combined technique may utilize an ion accelerator having a two-dimensional array of detector channels, arranged along the drift axis and along the transverse axis.

In other embodiments of the transverse position labeling technique, the transverse position of the ions may modulated at or downstream from the ion accelerator 862. In such embodiments, the ion dispersion device 844 may be integrated with or positioned downstream from the ion accelerator 862. The ion dispersion device 844 may be an ion deflector, such as described above. Alternatively, the ion dispersion device 844 may be a sector instrument as described above, located in the flight tube. These other embodiments may be less preferable if they result in TOF aberrations.

Transverse position labeling may be more advantageous when a gridded ion mirror is utilized, in comparison to a grid-less ion mirror. The curved fields in a grid-less mirror restrict the size of the transverse acceptance. On the other hand, a gridded mirror has an approximately uniform electric field within each stage, and consequently its acceptance in the transverse direction is typically larger than a grid-less mirror of the same size.

According to other embodiments of the present disclosure, the duty cycle of a TOF-MS system is improved by measuring ion mass directly in addition to the ion time of flight. The ion accelerator may again be multi-pulsed, meaning the TOF mass analyzer is multiplexed and has multiple different accelerator launches in it at any given time. A second ion detection channel that is sensitive to ion mass is used in conjunction with the TOF measurement to determine from which accelerator firing each ion originates. Together the TOF channel and the mass-sensitive channel are utilized to determine the actual ion time of flight. The mass-sensitive detector may be embodied in channels of a multi-channel detector. Alternatively, an in-flight mass-dispersive sector may be provided upstream of the multi-channel detector, either upstream of the ion accelerator or in the flight tube.

Several different mass-sensitive detector channels are possible. For example, the average single ion pulse height outputted by many electron multiplier ion detectors scales as $1/\sqrt{m}$ where m is the ion mass, although other scalings are possible. Average single-ion pulse height encodes ion mass provided a single ion at a time is observed on each detector channel, the scaling is monotonic, and the pulse height distribution is sufficiently narrow. By using multiple detector channels or pixels, the single ion regime can be extended to higher total ion fluxes. The resolution of the direct ion mass measurement will be limited by the pulse height distribution.

Figure 9:
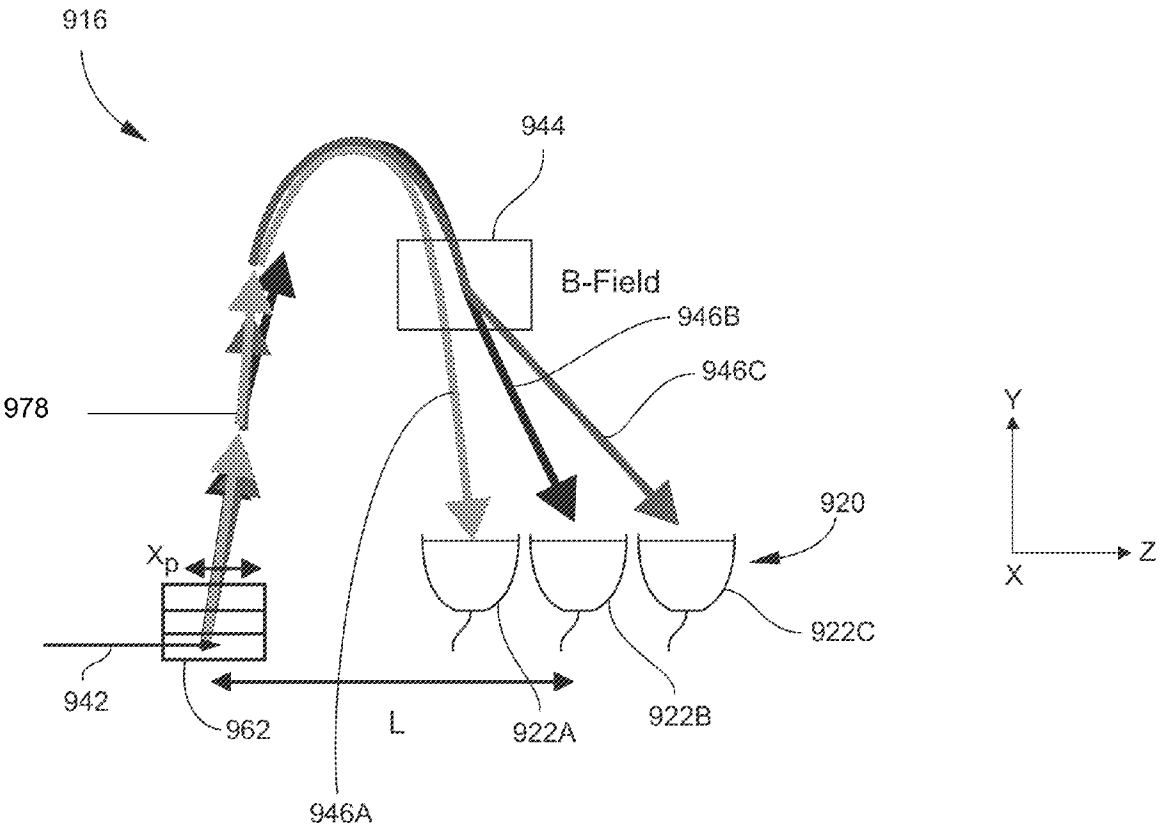
FIG. 9 is a schematic view in the y-z plane of an example of a TOF analyzer according to other embodiments.

In another embodiment, a mass-dispersive sector located in the TOF flight path. The ions are dispersed in space according to mass, and the position on the multi-channel detector encodes ion mass. The position on the multi-channel detector and time of ion arrival may be utilized together to constrain the possible accelerator firings and hence determine TOF. FIG. 9 is a schematic view in the y-z plane of an example of a TOF analyzer 916, showing an ion accelerator 962 and a multi-channel ion detector 920. The ion detector 920 includes a plurality of detection channels, for example detection channels 922A, 922B, and 922C, spatially separated along the drift axis. In the illustrated embodiment, the mass of the ions is analyzed (measured) in the flight tube, downstream of the ion accelerator 962. Accordingly a mass-sensitive ion dispersion device 944, such as a sector instrument as described above, is positioned in the flight tube. In operation, a primary ion beam 942 is transmitted into the ion accelerator 962, which injects ion packets into the flight tube along a main flight path 978, at pulse rate that may be a multiplexed pulse rate. The ion dispersion device 944 is positioned to receive the ion packets and output the ions into N different mass-resolved flight paths, for example flight paths 946A, 946B, and 946C, which are spatially separated along the drift axis. In the illustrated example N=3 but in other examples may be less than or more than 3. The ions in the flight paths 946A, 946B, and 946C arrive at respective detection channels 922A, 922B, and 922C that are spatially (optically) aligned with the flight paths 946A, 946B, and 946C.

Alternatively, the mass-sensitive ion dispersion device 944 may be positioned (oriented) to cause ion deflection in the flight tube along the transverse axis instead of along the drift axis. In this case, the detection channels 922A, 922B, 922C, and 922D would be spatially separated along the transverse axis. In a further embodiment, the mass-sensitive ion dispersion device 944 may be positioned to output ion beams spaced in parallel along the transverse axis as just described, and is operated in combination with the drift energy labeling technique described above. In this case, the ion accelerator 962 may include a two-dimensional array of detector channels arranged along the drift axis and along the transverse axis.

In another embodiment, the mass-sensitive ion dispersion device 944 may be located upstream of the ion accelerator 962, as described above and illustrated in FIG. 8. In this case, the ion beam modulator 944 outputs multiple parallel, transversely spaced, mass-resolved ion beams that are simultaneously transmitted into the ion accelerator 962. This embodiment is similar to the transverse position labeling technique discussed above in which an ion deflector is utilized, except that in this embodiment the mass range each detector channel sees is restricted and the aberrations caused by the magnetic or electric deflection do not degrade mass resolution because the deflection occurs outside the flight tube. As also described above, in such embodiment the ion accelerator 962 may include an array of ion accelerators arranged along the transverse axis. The ion accelerators may be operated at different rates, each optimized for their respective mass range.

Figure 10:
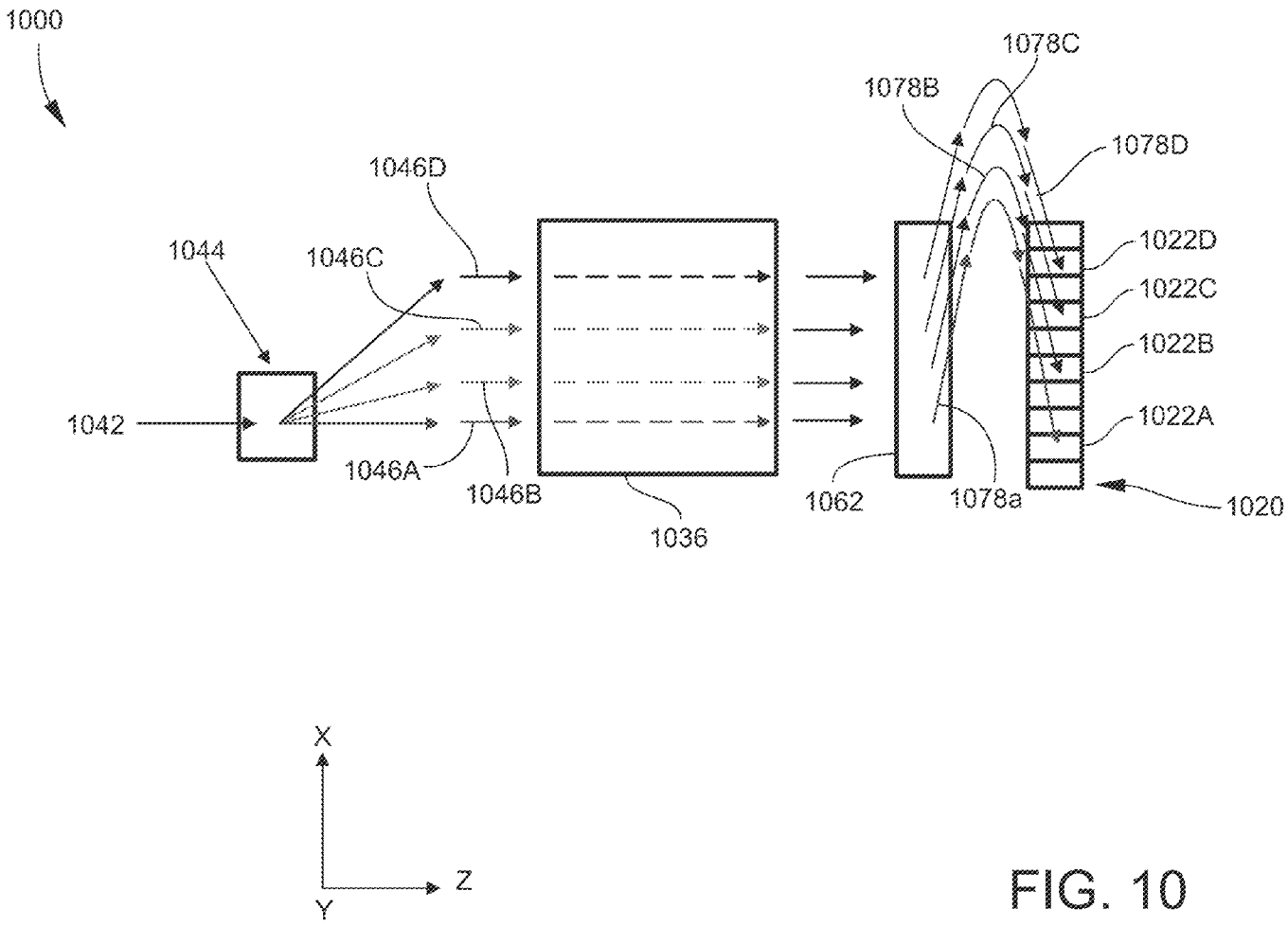
FIG. 10 is a schematic view in the x-z plane of an example of a TOF-MS system according to other embodiments.

FIG. 10 is a schematic view in the x-z plane of an example of a TOF-MS system 1000 according to other embodiments. In particular, FIG. 10 illustrates an example of implementing a tandem MS technique on parallel ion beams spaced along the transverse axis. The TOF-MS system 1000 includes a mass-sensitive ion dispersion device 1044, followed by a multi-channel (or multi-beam) ion fragmentation device 1036, followed by a TOF analyzer 1016.

The mass-sensitive ion dispersion device 1044 operates as described above, receiving a primary ion beam 1042 (a beam of "precursor," or "parent," ions in this embodiment) and outputting a plurality of parallel ion beams 1046A, 1046B, 1046C, and 1046D spatially dispersed along the transverse axis according to ion mass. In the illustrated example, the number N of parallel ion beams is four but in other examples may be less than or more than four. The TOF analyzer 1016 includes an ion accelerator 1062 and a multi-channel ion detector 1020. The ion detector 1020 includes a plurality of detection channels, for example detection channels 1022A, 1022B, 1022C, and 1022D, spatially separated along the transverse axis. The ion beams 1046A, 1046B, 1046C, and 1046D are processed in the ion fragmentation device 1036 as described below, and then transmitted into the ion accelerator 1062 simultaneously. The ion accelerator 1062 then injects successive ion packets from each ion beam 1046A, 1046B, 1046C, and 1046D either simultaneously or at different firing rates. Consequently, the ion packets travel through the flight tube simultaneously in N different flight paths 1078A, 1078B, 1078C, and 1078D that are spatially separated along the transverse axis. The ions in the N different flight paths 1078A, 1078B, 1078C, and 1078D thus arrive at respective detection channels 1022A, 1022B, 1022C, and 1022D, which are spatially (or optically) aligned with the respective flight paths 1078A, 1078B, 1078C, and 1078D. The impact of an ion on a particular detection channel 1022A, 1022B, 1022C, and 1022D thus determines the ion packet (associated with one of the flight paths 1078A, 1078B, 1078C, and 1078D) and the ion beam 1046A, 1046B, 1046C, and 1046D from which that particular ion originated.

It will be noted that in FIG. 10, the bends in the flight paths 1078A, 1078B, 1078C, and 1078D are to be considered as being located at elevations on the acceleration axis. Thus, the flight paths 1078A, 1078B, 1078C, and 1078D are to be considered as projecting out of the drawing sheet.

As schematically shown in FIG. 10, the ion accelerator 1062 is configured so as to be wide enough along the transverse axis to simultaneously receive multiple, transversely spaced ion beams. The ion accelerator 1062 thus may be considered as including multiple loading/injection sites or as including a plurality of transversely spaced, individually controllable ion accelerators, as described above in conjunction with FIG. 8. Thus, the separate ion accelerators may be operated to accelerate ion packets from respective ion beams 1046A, 1046B, 1046C, and 1046D simultaneously and at the same firing rate, or at different rates. Similarly, the TOF analyzer 1016 may include one wide ion mirror or multiple ion mirrors in the flight tube.

The ion fragmentation device 1036 may generally have any configuration effective for fragmenting ions in each ion beam 1046A, 1046B, 1046C, and 1046D, i.e., performing fragmentation simultaneously on N different ion beams (or channels). In some implementations, the ion fragmentation device 1036 is a buffer gas-filled collisional cell that implements CID, although alternatively may be another type of ion fragmentation device as described above. The ion fragmentation device 1036 may include a plurality of discrete devices arranged in parallel to separately receive the respective ion beams 1046A, 1046B, 1046C, and 1046D and output respective beams of fragment ions ("product" or "daughter" ions). Alternatively, the ion fragmentation device 1036 may be a single or integrated device configured for maintaining localized ion beams while performing fragmentation on the ion beams simultaneously. For example, in some embodiments the ion fragmentation device 1036 may be an RF ion guide.

Figure 11:
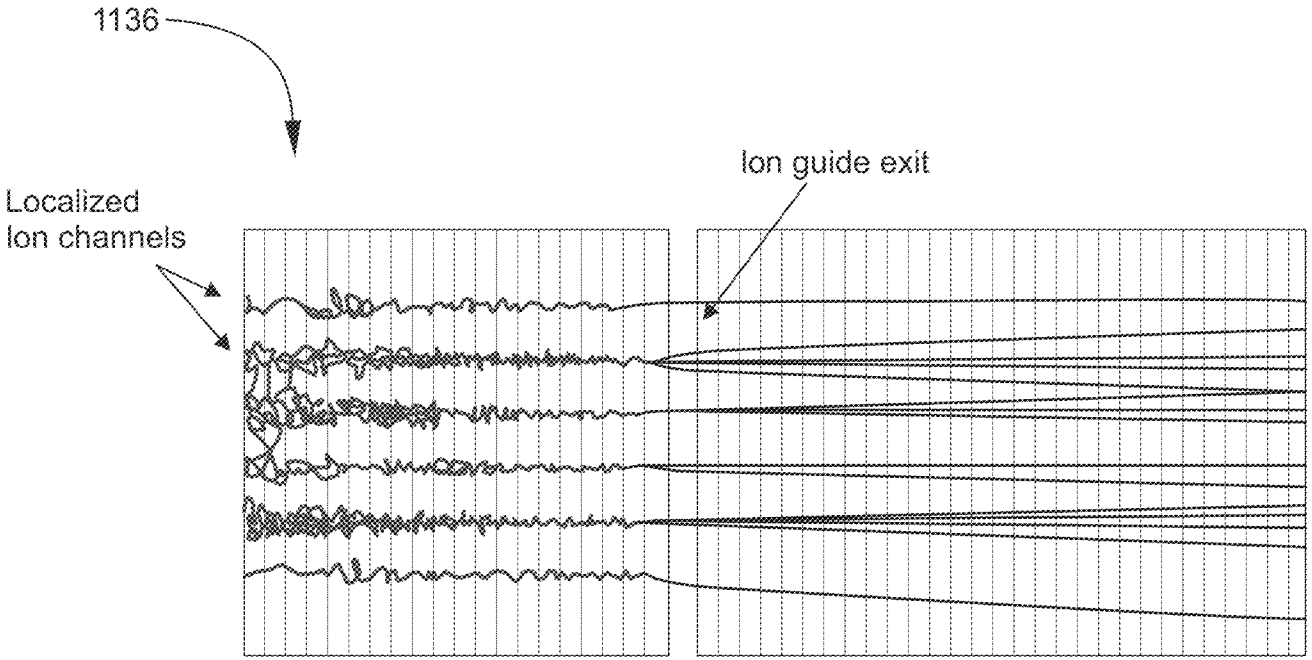
FIG. 11 is a schematic view in the x-z plane of an example of an RF ion guide configured as a multi-channel ion fragmentation device, according to some embodiments.

FIG. 11 is a schematic view of an example of an RF ion guide 1136 configured for maintaining localized ion beams while performing fragmentation on the ion beams simultaneously. The RF ion guide 1136 is configured to generate an RF field in its interior that has pseudo-potential barriers extending along the axial length of the RF ion guide. In the transverse direction, the RF field alternates between pseudo-potential barriers and local minima, thereby forming parallel ion channels along the axial length of the RF ion guide 1136. FIG. 11 includes a simulation of parallel ion beams traveling through the respective channels. The pseudo-potential barriers may be configured to reduce or prevent cross-talk between adjacent channels.

Referring again to FIG. 10, in operation the mass-sensitive ion dispersion device 1044 operates as the first-stage mass analyzer of the TOF-MS system 1000. The parallel ion beams 1046A, 1046B, 1046C, and 1046D are transmitted into the ion fragmentation device 1036 simultaneously. In the ion fragmentation device 1036, the ions travel in localized channels, i.e., the distinct parallel ion beams 1046A, 1046B, 1046C, and 1046D are maintained, which correspond to different ranges of parent ion m/z values due to the spatial separation induced by the mass-sensitive ion dispersion device 1044. In each channel, fragment ions are produced from the parent ions by CID or other fragmentation mechanism. The ion beams 1046A, 1046B, 1046C, and 1046D are outputted from the ion fragmentation device 1036 and then transmitted into the ion accelerator 1062 simultaneously. The TOF analyzer 1016 operates as described above to produce fragmentation spectra from the outputs of the detection channels 1022A, 1022B, 1022C, and 1022D. It is thus evident that the combination of the mass-sensitive ion beam modulator 1044, multi-channel (or multi-beam) ion fragmentation device 1036, and multi-channel (or multi-beam) TOF analyzer 1016 enable the fragmentation spectra of multiple different parent ions to be analyzed simultaneously in the TOF mass analyzer 1016, which improves the net ion transmission efficiency.

The TOF-MS system 1000 implements multi-pulsing at least by way of simultaneously transmitting respective ion packets in parallel flight paths in the flight tube, and simultaneously detecting ion arrival times at the same number of detector channels. In some embodiments, the ion packets are accelerated at a normal (non-multiplexed) firing rate. In this case, with $N_{det}$ detector channels, again it is seen that the duty cycle is improved by a factor of $N_{det}$, up to the point at which it reaches 100%. Moreover, the raw data produced by the $N_{det}$ detector channels are easily processed to construct a single mass spectrum. In other embodiments, the ion packets may be accelerated at a multiplexed firing rate, resulting in more than one ion packet traveling in each parallel flight path in the flight tube at the same time. In this case, some form of deconvolution/demodulation/decoding algorithm would likely be required to produce an easily interpretable mass spectrum.

In other embodiments, the TOF-MS system 1000 may be configured to perform a combination of the transverse parent ion mass separation technique just described and the drift energy labeling technique described earlier in this disclosure. As described earlier in this disclosure, this "two-dimensional" multi-pulsing or multiplexing technique enables ion packets to be accelerated at a multiplexed firing rate simultaneously into multiple parallel, transversely spaced flight paths, which may result in a significantly improved duty cycle while enabling a simplified demodulation algorithm to be employed due to the use of drift energy encoding. The ion accelerator 1062 in such embodiments may provide a two-dimensional array of detector channels, arranged along the drift axis and along the transverse axis.

Figure 12A:
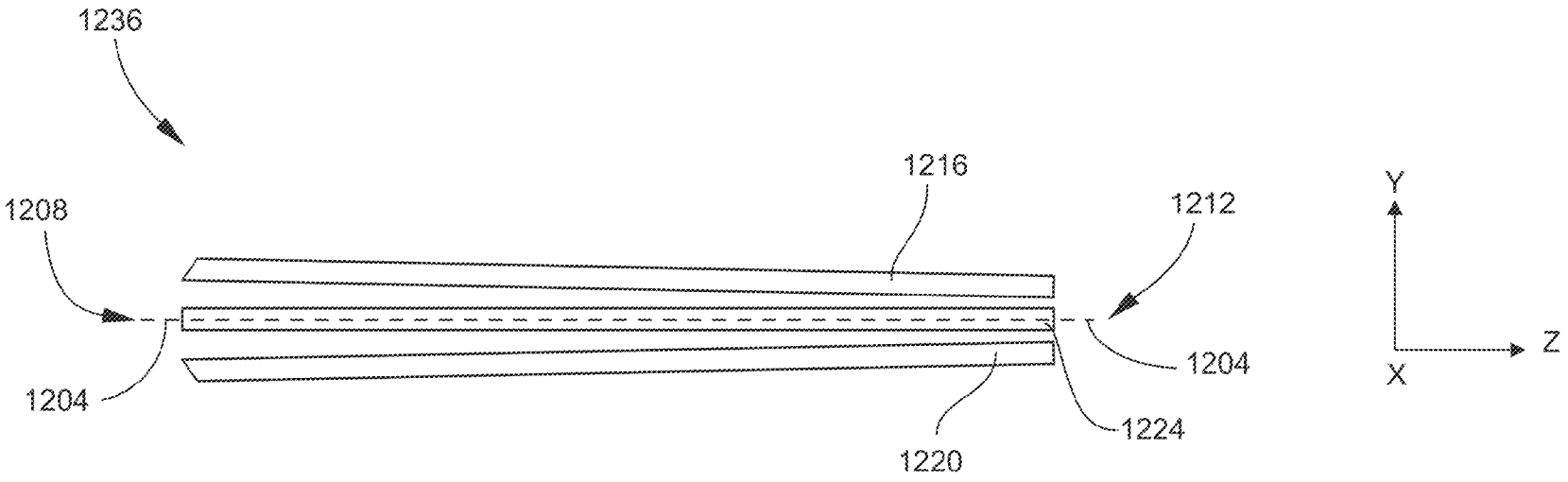
FIG. 12A is a side (length-wise) view in the y-z plane of another example of an RF ion guide configured as a multi-channel ion fragmentation device, according to some embodiments.
Figure 12B:
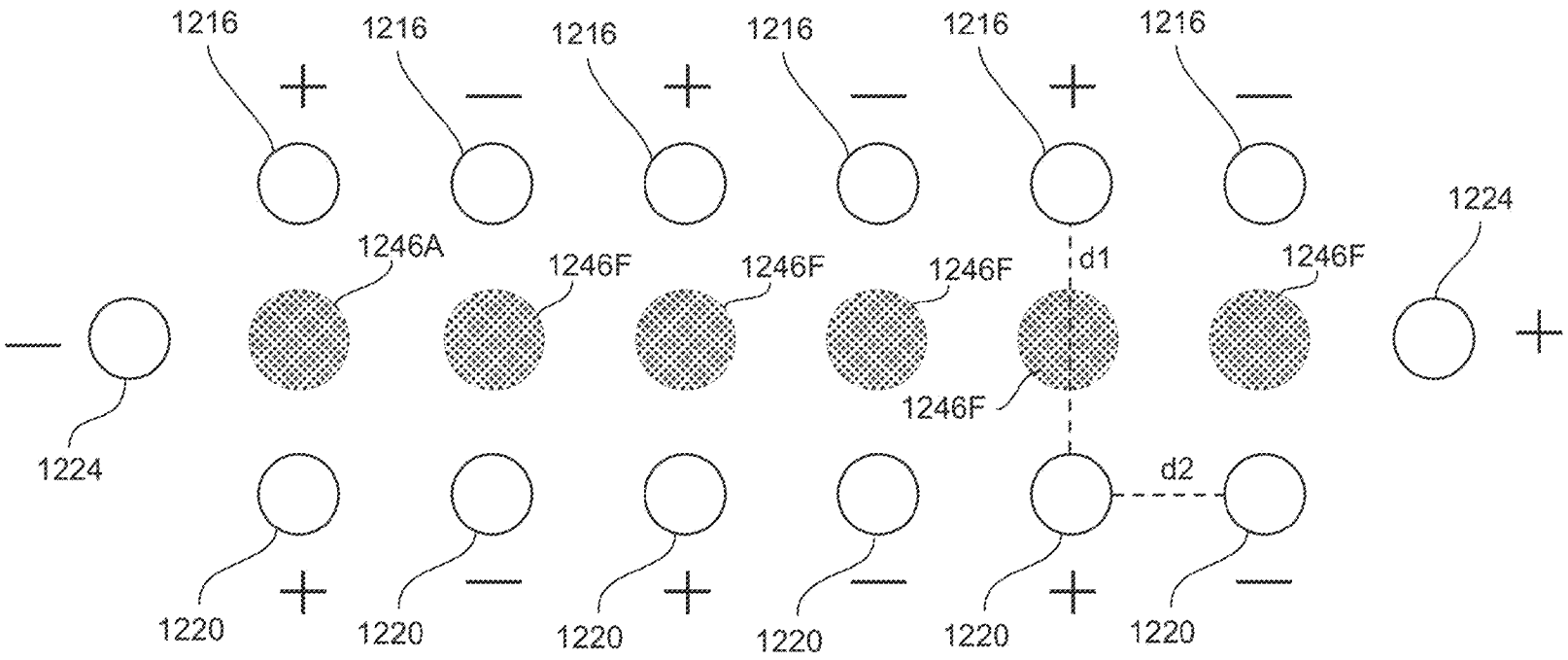
FIG. 12B is a cross-sectional view in the x-y plane of the RF ion guide illustrated in FIG. 12A.

FIG. 12A is a side (length-wise) view in the y-z plane of an example of an RF ion guide 1236 configured as a multi-channel ion fragmentation device, which may be utilized in the TOF-MS system 1000 or other TOF-MS system. FIG. 12B is a cross-sectional view in the x-y plane of the RF ion guide 1236. The RF ion guide 1236 is a multipole ion guide that includes a plurality of ion guide electrodes (or rods) elongated along a central axis 1204 of the RF ion guide 1236 (z-axis in FIG. 12A). The ion guide electrodes extend from an ion entrance end 1208 to an ion exit end 1212 of the RF ion guide 1236. The ion guide electrodes may be considered as including upper ion guide electrodes 1216 located at a transverse distance from the central axis 1204 in the positive y-direction, lower ion guide electrodes 1220 located at a transverse distance from the central axis 1204 in the negative y-direction (axially opposite the upper ion guide electrodes 1216), and lateral ion guide electrodes 1224 located axially opposite each other relative to the x-axis and between the upper ion guide electrodes 1216 and lower ion guide electrodes 1220 relative to the y-axis. In the present context, the terms "upper" and "lower" are used merely in a relative sense, and not as a limitation of the spatial orientation of the RF ion guide 1236. The ion guide electrodes 1216, 1220, and 1224 are spaced from each other around the central axis 1204 in the transverse (x-y) plane orthogonal to the axis, such that the ion guide electrodes 1216, 1220, and 1224 surround an ion guide volume that is elongated along the central axis 1204.

As shown in FIG. 12B, the ion guide electrodes 1216, 1220, and 1224 are positioned such that the cross-section of the ion guide volume is relatively wide along the x-axis and relatively narrow or "flattened" along the y-axis. The cross-section of the ion guide volume as being shaped as a flattened circle, flattened oval, or racetrack. The distance between opposing upper ion guide electrodes 1216 and lower ion guide electrodes 1220 is indicated as d1. The distance between adjacent upper ion guide electrodes 1216 and between adjacent lower ion guide electrodes 1220 is indicated as d2. RF potentials are applied to the ion guide electrodes 1216, 1220, and 1224 such that the phase on each ion guide electrode is shifted 180 degrees ($\pi$ rads) from the phase on the two adjacent ion guide electrodes. In other words, the polarity of the RF potential alternates from one ion guide electrode to the next, as depicted by positive "+" and negative "−" signs in FIG. 12B. Also in the present embodiment with the flattened geometry, the polarity is the same on opposing upper ion guide electrodes 1216 and lower ion guide electrodes 1220. If the distance d1 is small enough, the pseudo-potential exhibited by the RF field will provide alternating pseudo-potential barriers and local minima as described above, enabling confinement of multiple parallel ion beams 1246A, 1246B, 1246C, 1246C, 1246D, 1246E, and 1246F. The isolation between the ion beams may improve as the distance d1 approaches the distance d2.

In the non-limiting example of FIG. 12B, the RF ion guide 1236 is a 14-pole ion guide that includes six upper ion guide electrodes 1216, six lower ion guide electrodes 1220, and two lateral ion guide electrodes 1224. This geometry results in the formation of six ion beam channels, whereby six ion beams 1246A, 1246B, 1246C, 1246C, 1246D, 1246E, and 1246F may be confined. However, less or more than fourteen poles may be realized. In one non-limiting example of a class of geometries that may be realized for the RF ion guide 1236, the total number n of ion guide electrodes 1216, 1220, and 1224 may be described by n=2m+2, where m is the number of ion beam channels formed by the RF field.

In some embodiments and as illustrated in FIG. 12A, the ion guide electrodes 1216, 1220, and 1224 may have a converging geometry along at least the y-axis, and over the entire axial length of the RF ion guide 1236 or at least a portion thereof. That is, the distance d1 (FIG. 12B) tapers down as one moves in the positive direction along the central axis 1204 toward the ion exit end 1212. In other embodiments, however, the ion guide electrodes 1216, 1220, and 1224 may have a straight geometry in which they are all parallel with the central axis 1204 along the entire axial length of the RF ion guide 1236. The converging geometry may be implemented for the purpose of, for example, compressing the ion beams 1246A, 1246B, 1246C, 1246C, 1246D, 1246E, and 1246F. On the other hand, it may be desirable to reduce taper angle, possibly down to zero degrees (straight geometry) to reduce cross-talk between the ion beam channels at the ion entrance end 1208.

Figure 13:
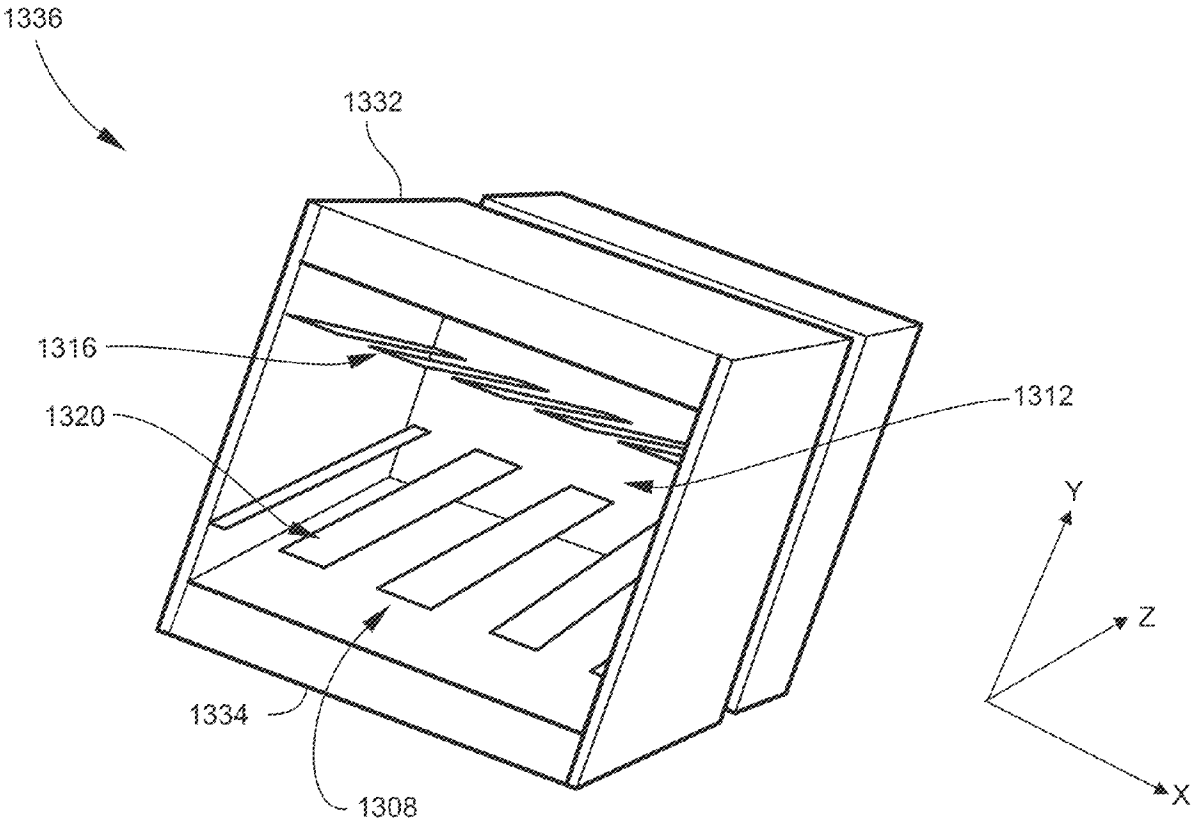
FIG. 13 is a perspective view of another example of an RF ion guide configured as a multi-channel ion fragmentation device, according to some embodiments.

FIG. 13 is a perspective view of another example of an RF ion guide 1336 configured as a multi-channel ion fragmentation device, which may be utilized in the TOF-MS system 1000 or other TOF-MS system. The RF ion guide 1336 includes a plurality of planar ion guide electrodes (or strips) elongated along a central axis of the RF ion guide 1336 (z-axis in FIG. 13). The ion guide electrodes extend from an ion entrance end 1308 to an ion exit end 1312 of the RF ion guide 1236. The ion guide electrodes may be considered as including upper ion guide electrodes 1316 located at a transverse distance from the central axis in the positive y-direction, and lower ion guide electrodes 1320 located at a transverse distance from the central axis in the negative y-direction (axially opposite the upper ion guide electrodes 1316. In the present context, the terms "upper" and "lower" are used merely in a relative sense, and not as a limitation of the spatial orientation of the RF ion guide 1336. The upper ion guide electrodes 1316 are spaced from each other along x-axis 1204, and the lower ion guide electrodes 1320 are likewise spaced from each other along x-axis 1204. An ion guide volume is defined between the upper ion guide electrodes 1316 and the lower ion guide electrodes 1320, and is likewise elongated along the central axis.

The upper ion guide electrodes 1316 may be supported on a planar upper substrate 1332, and the lower ion guide electrodes 1320 may be likewise supported on a planar lower substrate 1334. For illustrative purposes, the upper ion guide electrodes 1316 and lower ion guide electrodes 1320 are shown detached from the upper substrate 1332 and lower substrate 1334. In some embodiments, the upper ion guide electrodes 1316 and lower ion guide electrodes 1320 have features (e.g., thickness or height from the substrates 1332 and 1334, width along x-axis) on the order of micrometers, and may be fabricated on the substrates 1332 and 1334 by techniques utilized in the fabrication of micro-electronics, micro-electromechanical systems (MEMS), etc.

As in the case of the RF ion guide 1236 described above and illustrated in FIG. 12A and FIG. 12B, the upper ion guide electrodes 1316 and lower ion guide electrodes 1320 are positioned such that the cross-section of the ion guide volume is relatively wide along the x-axis and relatively narrow or "flattened" along the y-axis. RF potentials are applied to the upper ion guide electrodes 1316 and lower ion guide electrodes 1320 such that the phase on each upper ion guide electrode 1316 is shifted 180 degrees from the phase on any upper ion guide electrode 1316 adjacent thereto, and the phase on each lower ion guide electrode 1320 is shifted 180 degrees from the phase on any lower ion guide electrode 1320 adjacent thereto. Also, the polarity is the same on opposing upper ion guide electrodes 1316 and lower ion guide electrodes 1320. As in the case of the RF ion guide 1236 of FIG. 12A and FIG. 12B, the upper ion guide electrodes 1316 and lower ion guide electrodes 1320 are configured such that the pseudo-potential exhibited by the RF field will provide alternating pseudo-potential barriers and local minima, enabling confinement of multiple parallel ion beams. In the non-limiting example of FIG. 13, the RF ion guide 1336 includes five upper ion guide electrodes 1316 and five lower ion guide electrodes 1320. This geometry results in the formation of five ion beam channels, whereby six may be confined. However, less or more than five pairs of upper ion guide electrodes 1316 and lower ion guide electrodes 1320 may be realized. Sidewalls opposing each other along the x-axis, and positioned in the y-z plane between the upper substrate 1332 and lower substrate 1334, may be or include electrodes to which repelling DC potentials are applied to provide lateral ion barriers.

As described above with regard to the RF ion guide 1236 of FIG. 12A and FIG. 12B, the upper ion guide electrodes 1316 and lower ion guide electrodes 1320 may have a converging geometry along at least the y-axis as illustrated, or alternatively may have a straight geometry in which the upper ion guide electrodes 1316 and lower ion guide electrodes 1320 are all parallel with the central axis.

Embodiments of TOF analyzers herein have been described primarily in the context of orthogonal acceleration (oa-TOF). However, the present disclosure also encompasses coaxial TOF analyzers, i.e., TOF analyzers that accelerate ion packets into the flight tube along the same drift axis as the primary ion beam supplying the ions to the ion accelerator. For example, embodiments disclosed herein entailing modulation or dispersion of the ion beam along the transverse axis may be implemented with coaxial TOF analyzers. In addition, the present disclosure encompasses TOF analyzers that do not include ion mirrors in the flight tube.

From the foregoing, it is seen that embodiments disclosed herein may improve some of the major sources of poor ion transmission efficiency in TOF-MS. One or more embodiments utilize multi-channel ion detectors to significantly improve the average ion transmission and thereby improve sensitivity, dynamic range, mass accuracy, resolution, and speed. One or more embodiments address the so-called duty-cycle loss. One or more embodiments address the losses associated with mass isolation in tandem MS by utilizing multi-channel ion detectors and associated ion optics to parallelize the measurement. One or more embodiments utilize multi-pulsing of the ion-accelerator, and utilize the ion signals from multiple detector channels to reconstruct the mass spectrum. Unlike past approaches to multi-pulsing, one or more embodiments disclosed herein utilize reduced statistical inference, or no statistical inference, to reconstruct the spectrum.

EXEMPLARY EMBODIMENTS

Exemplary embodiments provided in accordance with the presently disclosed subject matter include, but are not limited to, the following:

1. A time-of-flight mass spectrometry (TOF-MS) system, comprising: an ion source; a TOF analyzer comprising an ion accelerator, a flight tube, and an ion detector comprising a plurality of channels; and an ion dispersion device configured for dispersing ions from the ion source into a plurality of spatially separated flight paths in the flight tube, wherein respective channels are aligned with the flight paths.

2. The TOF-MS system of embodiment 1, wherein the ion dispersion device is positioned upstream of the ion accelerator, at the ion accelerator, or in the flight tube.

3. The TOF-MS system of embodiment 1, wherein the ion dispersion device comprises a voltage source communicating with the ion accelerator, with ion optics upstream of the ion accelerator, or with both of the foregoing.

4. The TOF-MS system of embodiment 1 or 2, wherein the ion dispersion device comprises an ion deflector or a sector instrument.

5. The TOF-MS system of any of the preceding embodiments, wherein the ion dispersion device comprises a first dispersion device configured for dispersing ions along a drift axis, and a second dispersion device configured for dispersing ions along a transverse axis orthogonal to the drift axis, and wherein the flight paths are spatially separated according to positions defined by both the transverse axis and the drift axis.

6. The TOF-MS system of any of embodiments 1, 2, 4 or 5, wherein the ion dispersion device is configured for dispersing ions into a plurality of spatially separated ion beams, and the ion accelerator comprises a plurality of ion accelerators positioned to receive the respective ion beams.

7. The TOF-MS system of any of the preceding embodiments, wherein the ion detector is configured for both detecting arrival times of ions and measuring masses of the ions.

8. The TOF-MS system of embodiment 1, 2, 4, 6, or 7, wherein the ion dispersion device is configured for dispersing ions into a plurality of spatially separated ion beams, and further comprising an ion guide between the ion dispersion device and the ion accelerator, the ion guide configured for receiving the spatially separated ion beams simultaneously from the ion dispersion device, and wherein the ion accelerator is configured for receiving the spatially separated ion beams.

9. The TOF-MS system of embodiment 8 wherein the ion guide is configured for generating a radio frequency (RF) electric field in the ion guide, wherein the RF electric field comprises pseudo-potential barriers that isolate adjacent ion beams.

10. The TOF-MS system of embodiment 8 or 9, wherein the ion guide is configured for fragmenting the ions in each ion beam.

11. The TOF-MS system of any of embodiments 8 to 10, wherein the ion guide comprises a plurality of electrodes elongated along a drift axis and defining an ion guide volume having a cross-section defined by a transverse axis orthogonal to the drift axis and an acceleration axis orthogonal to the drift axis and to the transverse axis, and wherein the cross-section is larger along the transverse axis than along the acceleration axis, and the ion beams a spatially separated along the transverse axis.

12. A method for performing time-of-flight mass spectrometry (TOF-MS), the method comprising: transmitting ions along a drift axis into an ion accelerator; injecting the ions as a plurality of sequential ion packets from the ion accelerator into a flight tube; modulating a drift energy of the ions according to a repeating modulation sequence comprising a plurality of iterations, wherein the drift energy at each iteration is different from the drift energies of the other iterations, and wherein the ions travel in the flight tube in a plurality of flight paths spatially separated along the drift axis; and detecting arrival times of the ions at a plurality of channels of an ion detector aligned with the respective flight paths.

13. The method of embodiment 12, comprising injecting the ions as a plurality of sequential ion packets at a multiplexed pulse rate.

14. The method of embodiment 12 or 13, comprising producing a plurality of raw mass spectra from the respective channels, and deconvoluting the modulation sequence from the raw mass spectra to produce a single mass spectrum.

15. The method of any of embodiments 12 to 14, comprising modulating the drift energy of the ions according to a modulation selected from the group consisting of: modulating the drift energy of the ions before the ions are transmitted into the ion accelerator; modulating the drift energy of the ions after the ions are transmitted into the ion accelerator and before the ions are injected as ion packets into the flight tube; modulating the drift energy of the ions after the ions are injected as ion packets into the flight tube; and a combination of two or more of the foregoing.

16. The method of any of embodiments 12 to 15, comprising modulating the drift energy by varying a voltage at which the ions in the ion beam are transmitted into the ion accelerator.

17. The method of embodiment 16, wherein varying the voltage comprises varying a direct current (DC) potential applied to the ion accelerator, varying a DC potential applied to an ion optics element upstream of the ion accelerator, or both of the foregoing.

18. The method of any of embodiments 12 to 15, comprising modulating the drift energy by operating an ion dispersion device at the ion accelerator or in the flight tube.

19. The method of embodiment 18, wherein the ion dispersion device comprises an ion deflector or a sector instrument.

20. A method for performing time-of-flight mass spectrometry (TOF-MS), the method comprising: transmitting ions along a drift axis into an ion accelerator; injecting the ions as a plurality of sequential ion packets from the ion accelerator into a flight tube; modulating a transverse position the ions such that the ions travel in the flight tube in a plurality of flight paths spatially separated along a transverse axis orthogonal to the drift axis; and detecting arrival times of the ions at a plurality of channels of an ion detector aligned with the respective flight paths.

21. The method of embodiment 20, comprising modulating the transverse position according to a repeating modulation sequence comprising a plurality of iterations, wherein at each iteration the ions are dispersed to a transverse position different from the transverse positions of the other iterations.

22. The method of embodiment 21, wherein the ions are injected as a plurality of sequential ion packets in a plurality of corresponding accelerator firing events, and further comprising: associating the iterations of the modulation sequence with respective firing events such that different transverse positions of the modulation sequence are correlated with different accelerator firing events; producing a plurality of raw mass spectra from the respective channels; and deconvoluting the modulation sequence from the raw mass spectra to produce a single mass spectrum.

23. The method of embodiment 22, comprising injecting the ions as a plurality of sequential ion packets at a multiplexed pulse rate.

24. The method of any of embodiments 20 to 23, comprising modulating the transverse position of the ions according to a modulation selected from the group consisting of: dispersing the ions into a plurality of ion beams upstream of the ion accelerator, wherein the ion beams are spatially separated along the transverse axis, and the ion beams are transmitted along the drift axis into the ion accelerator; after transmitting the ions into the ion accelerator, dispersing the ions in the ion accelerator such that the ion packets are injected into the flight tube along the respective flight paths; after injecting the ion packets into the flight tube, dispersing ions from the ion packets into the respective flight paths; and a combination of two or more of the foregoing.

25. The method of any of embodiments 20 to 24, comprising modulating the transverse position by operating an ion dispersion device upstream of the ion accelerator, at the ion accelerator, or in the flight tube.

26. The method of embodiment 25, wherein ion dispersion device comprises an ion deflector or a sector instrument.

27. The method of any of embodiments 20 to 26, comprising modulating a drift energy of the ions according to a repeating modulation sequence comprising a plurality of iterations, wherein the drift energy at each iteration is different from the drift energies of the other iterations, and wherein the ions travel in the flight tube in a plurality of different flight paths that are spatially separated along the drift axis in addition to being spatially separated along the transverse axis, and the arrival times of the ions are detected at respective channels of the ion detector that are arranged in a two-dimensional array along the transverse axis and the drift axis.

28. The method of any of embodiments 20 to 27, comprising producing a plurality of raw mass spectra from the respective channels, and deconvoluting the modulation from the raw mass spectra to produce a single mass spectrum.

29. The method of any of embodiments 20 to 28, wherein: modulating the transverse position of the ions comprises dispersing the ions into a plurality of ion beams upstream of the ion accelerator, wherein the ion beams are spatially separated along the transverse axis, and the ion beams are transmitted along the drift axis into the ion accelerator; the ion accelerator comprises a plurality of ion accelerators respectively aligned with the ion beams; and further comprising operating the ion accelerators at different pulse rates.

30. A method for performing time-of-flight mass spectrometry (TOF-MS), the method comprising: transmitting ions along a drift axis into an ion accelerator; injecting the ions into a flight tube in a plurality of sequential accelerator firing events; detecting arrival times of the ions at a multichannel ion detector; measuring masses of the ions of each of the ion packets; and based on the detected arrival times and measured masses, determining from which accelerator firing event each ion was injected.

31. The method of embodiment 30, wherein measuring masses is done at one or more mass-sensitive channels of the ion detector.

32. The method of embodiment 31, wherein measuring masses comprises measuring average pulse heights outputted by the ion detector for each ion detected.

33. The method of embodiment 30, wherein measuring masses comprises transmitting the ions into a sector instrument in the flight tube, and outputting the ions from the sector instrument in a plurality of mass-discriminated, spatially separated flight paths, such that the arrival times of the ions are detected at a plurality of channels of the ion detector respectively aligned with the flight paths.

34. The method of embodiment 33, wherein the mass-discriminated flight paths are spaced from each other along the drift axis, or along a transverse axis orthogonal to the drift axis.

35. The method of embodiment 30, wherein: measuring masses comprises transmitting the ions into a sector instrument upstream of the ion accelerator, and outputting the ions from the sector instrument in a plurality of mass-discriminated, spatially separated ion beams; transmitting ions along the drift axis into the ion accelerator comprises transmitting the ions in the respective ion beams into the ion accelerator; injecting the ions into the flight tube comprises transmitting the ions in a plurality of mass-discriminated, spatially separated flight paths corresponding to the respective ion beams; and the arrival times of the ions are detected at a plurality of channels of the ion detector respectively aligned with the flight paths.

36. The method of embodiment 35, wherein the ion accelerator comprises a plurality of ion accelerators respectively aligned with the ion beams, and further comprising operating the ion accelerators at different pulse rates.

37. The method of any of embodiments 30 to 36, comprising producing a plurality of raw mass spectra from respective channels of the ion detector, and based on a correlation between each ion and the accelerator firing event from which the ion was injected, deconvoluting the raw mass spectra to produce a single mass spectrum.

38. The method of any of embodiments 30 to 37, comprising injecting the ions into the flight tube at a multiplexed pulse rate.

39. A method for performing time-of-flight mass spectrometry (TOF-MS), the method comprising: transmitting ions into a sector instrument, and outputting the ions from the sector instrument in a plurality of mass-discriminated ion beams that are spatially separated along a transverse axis; transmitting the ion beams simultaneously into an ion accelerator along a drift axis orthogonal to the transverse axis; injecting ion packets from each of the ion beams into a flight tube, wherein the ion packets travel through the flight tube simultaneously in a plurality of flight paths spatially separated along the transverse axis, the flight paths corresponding to the respective ion beams; and detecting arrival times of the ions at a plurality of channels of an ion detector aligned with the respective flight paths.

40. The method of embodiment 39, comprising transmitting the ion beams simultaneously through an ion guide between the sector instrument and the ion accelerator, wherein the ion guide is configured for maintaining a separation of the ion beams along the transverse axis.

41. The method of embodiment 40, comprising generating a radio frequency (RF) electric field in the ion guide, wherein the RF electric field comprises pseudo-potential barriers along the drift axis that isolate adjacent ion beams.

42. The method of embodiment 40 or 41, comprising fragmenting the ions in each ion beam while transmitting the ion beams through the ion guide.

43. The method of any of embodiments 40 to 42, wherein the ion guide comprises a plurality of electrodes elongated along the drift axis and defining an ion guide volume that is larger along the transverse axis than along an acceleration axis orthogonal to the drift axis and to the transverse axis.

44. The method of any of embodiments 39 to 43, wherein the ion accelerator comprises a plurality of ion accelerators respectively aligned with the ion beams, and further comprising operating the ion accelerators at different pulse rates.

45. The method of any of embodiments 39 to 44, comprising producing a plurality of raw mass spectra from the respective channels, and producing a single mass spectrum from the raw mass spectra.

46. The method of any of embodiments 39 to 45, comprising modulating a drift energy of the ions according to a repeating modulation sequence comprising a plurality of iterations, wherein the drift energy at each iteration is different from the drift energies of the other iterations, and wherein the ions travel in the flight tube in a plurality of different flight paths that are spatially separated along the drift axis in addition to being spatially separated along the transverse axis, and the arrival times of the ions are detected at respective channels of the ion detector that are arranged in a two-dimensional array along the transverse axis and the drift axis.

47. A time-of-flight mass spectrometry (TOF-MS) system configured for performing all or part of the method of any of the preceding embodiments.

48. A time-of-flight mass spectrometry (TOF-MS) system comprising: an ion source; a TOF analyzer; an ion detector; and a computing device configured for performing all or part of the method of any of the preceding embodiments.

49. A system for acquiring spectral data from a sample, the system comprising: a processor and a memory configured for performing all or part of the method of any of the preceding embodiments.

50. The system of embodiment 49, comprising a computing device and an ion detector, wherein the computing device comprises the processor and the memory, and the ion detector is configured for transmitting ion measurement signals to the computing device.

51. A computer-readable storage medium comprising instructions for performing all or part of the method of any of the preceding embodiments.

52. A system comprising the computer-readable storage medium of embodiment 51.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the computing device 140 schematically depicted in FIG. 1. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), or application specific integrated circuits (ASICs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the computing device 140 in FIG. 1), direct the electronic system to carry out the instructions. The computer program product may be selectively embodied in any non-transitory computer-readable storage medium for use by or in connection with an instruction execution system, apparatus, or device, such as an electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD-RW (optical); and digital versatile disc memory, i.e., DVD (optical). Note that the non-transitory computer-readable storage medium may even be paper or another suitable medium upon which the program is printed, as the program may be electronically captured via, for instance, optical scanning of the paper or other medium, then compiled, interpreted, or otherwise processed in a suitable manner if necessary, and then stored in a computer memory or machine memory.

It will also be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A time-of-flight mass spectrometry (TOF-MS) system, comprising:

an ion source;

a TOF analyzer comprising an ion accelerator, a flight tube, and an ion detector comprising a plurality of channels; and an electric field or magnetic field ion dispersion device comprising at least one of an electrode for generation of an electric field or a magnet for generation of a magnetic field, and configured for dispersing ions from the ion source into a plurality of spatially separated flight paths in the flight tube, wherein: before arriving at the detector, a drift energy of the ions is modulated according to a repeating modulation sequence comprising a plurality of iterations, the drift energy at each iteration is different from the drift energies of the other iterations, and respective channels of the ion detector are aligned with the flight paths.

2. The TOF-MS system of claim 1, wherein the ion dispersion device is positioned upstream of the ion accelerator, at the ion accelerator, or in the flight tube.

3. The TOF-MS system of claim 1, wherein the electrode-including ion dispersion device has a configuration selected from the group consisting of:

the electric field or magnetic field ion dispersion device comprises a voltage source communicating with the ion accelerator, with ion optics upstream of the ion accelerator, or with both of the foregoing;

the electric field or magnetic field ion dispersion device comprises an ion deflector or a sector instrument; and the electric field or magnetic field ion dispersion device comprises a first electric field or magnetic field dispersion device configured for dispersing ions along a drift axis, and a second electric field or magnetic field dispersion device configured for dispersing ions along a transverse axis orthogonal to the drift axis, and wherein the flight paths are spatially separated according to positions defined by both the transverse axis and the drift axis.

4. The TOF-MS system of claim 1, wherein the electric field or magnetic field ion dispersion device is configured for dispersing ions into a plurality of spatially separated ion beams, and the ion accelerator comprises a plurality of ion accelerators positioned to receive the respective ion beams.

5. The TOF-MS system of claim 1, wherein the ion detector is configured for both detecting arrival times of ions and measuring masses of the ions.

6. The TOF-MS system of claim 1, wherein the ion dispersion device is configured for dispersing ions into a plurality of spatially separated ion beams, and further comprising an ion guide between the electric field or magnetic field ion dispersion device and the ion accelerator, the ion guide configured for receiving the spatially separated ion beams simultaneously from the electric field or magnetic field ion dispersion device, and wherein the ion accelerator is configured for receiving the spatially separated ion beams.

7. The TOF-MS system of claim 6, wherein the ion guide has a configuration selected from the group consisting of:

the ion guide is configured for generating a radio frequency (RF) electric field in the ion guide, wherein the RF electric field comprises pseudo-potential barriers that isolate adjacent ion beams;

the ion guide is configured for fragmenting the ions in each ion beam; and the ion guide comprises a plurality of electrodes elongated along a drift axis and defining an ion guide volume having a cross-section defined by a transverse axis orthogonal to the drift axis and an acceleration axis orthogonal to the drift axis and to the transverse axis, and wherein the cross-section is larger along the transverse axis than along the acceleration axis, and the ion beams are spatially separated along the transverse axis.

8. A method for performing time-of-flight mass spectrometry (TOF-MS), the method comprising:

transmitting ions along a drift axis into an ion accelerator;

injecting the ions as a plurality of sequential ion packets from the ion accelerator into a flight tube;

modulating a drift energy of the ions according to a repeating modulation sequence comprising a plurality of iterations, wherein the drift energy at each iteration is different from the drift energies of the other iterations, and wherein the ions travel in the flight tube in a plurality of flight paths spatially separated along the drift axis; and detecting arrival times of the ions at a plurality of channels of an ion detector aligned with the respective flight paths.

9. The method of claim 8, comprising injecting the ions as a plurality of sequential ion packets at a multiplexed pulse rate.

10. The method of claim 8, comprising producing a plurality of raw mass spectra from the respective channels, and deconvoluting the modulation sequence from the raw mass spectra to produce a single mass spectrum.

11. The method of claim 8, comprising modulating the drift energy of the ions according to a modulation selected from the group consisting of:

modulating the drift energy of the ions before the ions are transmitted into the ion accelerator;

modulating the drift energy of the ions after the ions are transmitted into the ion accelerator and before the ions are injected as ion packets into the flight tube;

modulating the drift energy of the ions after the ions are injected as ion packets into the flight tube; and a combination of two or more of the foregoing.

12. The method of claim 8, comprising modulating the drift energy according to a step selected from the group consisting of:

modulating the drift energy by varying a voltage at which the ions in the ion beam are transmitted into the ion accelerator;

modulating the drift energy by varying a direct current (DC) potential applied to the ion accelerator, varying a DC potential applied to an ion optics element upstream of the ion accelerator, or both of the foregoing;

modulating the drift energy by operating an ion dispersion device at the ion accelerator or in the flight tube; and modulating the drift energy by operating an ion deflector or a sector instrument.

13. A method for performing time-of-flight mass spectrometry (TOF-MS), the method comprising:

transmitting ions from an ion source along a drift axis into an ion accelerator;

injecting the ions as a plurality of sequential ion packets from the ion accelerator into a flight tube;

modulating a drift energy of the ions according to a repeating modulation sequence comprising a plurality of iterations modulating a transverse position of the ions such that the ions travel in the flight tube in a plurality of flight paths spatially separated along a transverse axis orthogonal to the drift axis; and detecting arrival times of the ions at a plurality of channels of an ion detector aligned with the respective flight paths of the ions arriving at respective channels of the ion detector, wherein the drift energy at each iteration is different from the drift energies of the other iterations.

14. The method of claim 13, comprising modulating the transverse position according to a repeating modulation sequence comprising a plurality of iterations, wherein at each iteration the ions are dispersed to a transverse position different from the transverse positions of the other iterations.

15. The method of claim 14, wherein the ions are injected as a plurality of sequential ion packets in a plurality of corresponding accelerator firing events, and further comprising:

associating the iterations of the modulation sequence with respective firing events such that different transverse positions of the modulation sequence are correlated with different accelerator firing events;

producing a plurality of raw mass spectra from the respective channels; and deconvoluting the modulation sequence from the raw mass spectra to produce a single mass spectrum.

16. The method of claim 15, comprising injecting the ions as a plurality of sequential ion packets at a multiplexed pulse rate.

17. The method of claim 13, comprising modulating the transverse position of the ions according to a modulation selected from the group consisting of:

dispersing the ions into a plurality of ion beams upstream of the ion accelerator, wherein the ion beams are spatially separated along the transverse axis, and the ion beams are transmitted along the drift axis into the ion accelerator;

after transmitting the ions into the ion accelerator, dispersing the ions in the ion accelerator such that the ion packets are injected into the flight tube along the respective flight paths;

after injecting the ion packets into the flight tube, dispersing ions from the ion packets into the respective flight paths; and a combination of two or more of the foregoing.

18. The method of claim 13, comprising modulating the transverse position according to a step selected from the group consisting of:

modulating the transverse position by operating an ion dispersion device upstream of the ion accelerator, at the ion accelerator, or in the flight tube; and modulating the transverse position by operating an ion deflector or a sector instrument.

19. The method of claim 13, comprising modulating a drift energy of the ions according to a repeating modulation sequence comprising a plurality of iterations, wherein the drift energy at each iteration is different from the drift energies of the other iterations, and wherein the ions travel in the flight tube in a plurality of different flight paths that are spatially separated along the drift axis in addition to being spatially separated along the transverse axis, and the arrival times of the ions are detected at respective channels of the ion detector that are arranged in a two-dimensional array along the transverse axis and the drift axis.

20. The method of claim 13, wherein:

modulating the transverse position of the ions comprises dispersing the ions into a plurality of ion beams upstream of the ion accelerator, wherein the ion beams are spatially separated along the transverse axis, and the ion beams are transmitted along the drift axis into the ion accelerator;

the ion accelerator comprises a plurality of ion accelerators respectively aligned with the ion beams; and further comprising operating the ion accelerators at different pulse rates.

* * * * *